US011136845B2

(12) United States Patent
West et al.

(10) Patent No.: US 11,136,845 B2
(45) Date of Patent: Oct. 5, 2021

(54) CORING APPARATUS

(71) Applicant: FLEXIDRILL LIMITED, Auckland (NZ)

(72) Inventors: Gregory Donald West, Wanaka (NZ); Owen Schicker, Timaru (NZ)

(73) Assignee: FLEXIDRILL LIMITED, Auckland (NZ)

( * ) Notice: Subject to any disclaimer, the term of this patent is extended or adjusted under 35 U.S.C. 154(b) by 68 days.

(21) Appl. No.: 16/466,502

(22) PCT Filed: Nov. 23, 2017

(86) PCT No.: PCT/IB2017/057350
§ 371 (c)(1),
(2) Date: Jun. 4, 2019

(87) PCT Pub. No.: WO2018/104818
PCT Pub. Date: Jun. 14, 2018

(65) Prior Publication Data

US 2019/0338609 A1 Nov. 7, 2019

(30) Foreign Application Priority Data

Dec. 5, 2016 (NZ) ..... 727078

(51) Int. Cl.

| | |
|---|---|
| ***E21B 25/00*** | (2006.01) |
| ***E21B 4/02*** | (2006.01) |
| ***E21B 10/02*** | (2006.01) |
| ***E21B 25/10*** | (2006.01) |
| ***E21B 10/60*** | (2006.01) |
| *E21B 7/06* | (2006.01) |

(52) U.S. Cl.
CPC ..... *E21B 25/00* (2013.01); *E21B 4/02* (2013.01); *E21B 10/02* (2013.01); *E21B 10/605* (2013.01); *E21B 25/10* (2013.01); *E21B 7/067* (2013.01)

(58) Field of Classification Search
CPC ..... E21B 10/02; E21B 10/605; E21B 25/00; E21B 25/02; E21B 25/10
See application file for complete search history.

(56) References Cited

U.S. PATENT DOCUMENTS 2,944,792 A * 7/1960 Gros ..... E21B 4/02 175/107
5,048,619 A 9/1991 Leaney et al.
(Continued)

OTHER PUBLICATIONS

International Search Report issued in PCT/IB2017/057350; dated Mar. 2, 2018.
Written Opinion issued in PCT/IB2017/057350; dated Mar. 2, 2018.

*Primary Examiner* — Tara Schimpf
(74) *Attorney, Agent, or Firm* — Studebaker & Brackett PC

(57) ABSTRACT

In one aspect the present invention comprises a wireline retrievable coring apparatus for incorporation into a drill-string, comprising: a housing for coupling to a drill string housing, a drill bit, a turbine comprising a stator coupled to the housing and a rotor within the stator, the rotor coupled to rotate the drill bit, a core barrel through the turbine and in communication with the drill bit for capturing a core, a fluid path to the drill bit via the turbine to rotate the turbine, wherein the core barrel is rotationally isolated from the rotor and is fluidly isolated from the fluid path.

20 Claims, 23 Drawing Sheets

(56) References Cited

U.S. PATENT DOCUMENTS

| | | | | |
|---|---|---|---|---|
| 6,142,228 | A * | 11/2000 | Jogi | E21B 4/02 166/250.01 |
| 6,644,424 | B1 | 11/2003 | Fanuel | |
| 10,767,446 | B2 * | 9/2020 | Shimmoto | E21B 34/12 |
| 2011/0247879 | A1 * | 10/2011 | Johnston | E21B 47/10 175/58 |
| 2015/0300117 | A1 | 10/2015 | West | |
| 2019/0264521 | A1 * | 8/2019 | Mageren | E21B 10/02 |

* cited by examiner

CORING APPARATUS

FIELD OF THE INVENTION

The present specification relates to apparatus for coring in down hole drilling operations.

BACKGROUND TO THE INVENTION

In rock coring applications and specifically for mineral exploration in very hard and abrasive formations it is common to use a drill capable of rotating thin walled drill rods at high RPM (e.g. >800 RPM) in conjunction with Diamond impregnated (Impreg) drill bits.

The drill bit itself has a hollow centre (doughnut shaped) and as the bit advances into the formation being drilled, a cylinder of rock is able to advance into a core barrel (up-hole of the bit). Once the core barrel is full of rock, the drilling process stops and the core is retrieved.

To drill, the entire string of pipe is spun rapidly (up to 800 rpm for large coring rods or up to 1500 rpm for smaller rod) so that the bit on the end of the drill pipe can penetrate the rock formations. To improve rate of penetration, it is desirable to spin the drill string pipe at a higher RPM, But there are engineering limitations to increasing RPM. First, rotating the drill pipe requires lots of power at the top drive. This high speed rotation also causes heavy wear on the outside diameter (OD) of the entire drill string, so periodically the drill string or parts thereof need to be replaced due to this wear.

Simply rotating the drill string from surface to gain faster ROP (rate of penetration) is not feasible, as this requires much larger—more powerful drill rigs, that leads to higher wear on the drill rods (that are expensive) and further associated down hole tooling. Further the increased rpm will lead to radial vibration (unless the drill string is perfectly radially aligned) which is detrimental to ROP, hole straightness and potential safety issues at surface.

SUMMARY OF INVENTION

It is an object of the invention to provide a coring apparatus that can improve the rate of penetration and/or protect the core sample, or at least provide an alternative to existing coring apparatus.

In one aspect the present invention comprises a wireline retrievable coring apparatus for incorporation into a drillstring, comprising: a housing for coupling to a drill string housing, a drill bit, a turbine comprising a stator coupled to the housing and a rotor within the stator, the rotor coupled to rotate the drill bit, a core barrel through the turbine and in communication with the drill bit for capturing a core, a fluid path to the drill bit via the turbine to rotate the turbine, wherein the core barrel is rotationally isolated from the rotor and is fluidly isolated from the fluid path.

Preferably the apparatus further comprises a hollow drive train within the housing and coupled to the drill bit, the rotor being coupled to or forming part of the drive train to rotate the drill bit.

Preferably the core barrel is positioned in the hollow drive train and is rotationally isolated from the drive train.

Preferably the core barrel is positioned in the hollow drive train by a swivel which removably holds the core barrel in but rotationally isolates the core barrel from the drive train.

Preferably a slidably engageable seal is disposed between the swivel and the hollow drive train, wherein optionally the seal is pressure activated.

Preferably the swivel comprises a body that is removably coupled to the hollow drive train.

Preferably the seal is disposed between the body and the hollow drive train.

Preferably the core barrel is rotatably coupled to the swivel body.

Preferably the core barrel and swivel can be retrieved from the hollow drive train.

Preferably the coring apparatus further comprises a wireline retrieval assembly coupled to the swivel, and the core barrel and swivel can be retrieved from the hollow drive train by a wireline retrieval.

Preferably there is a gap between the hollow drive train and the housing forming part of the fluid path.

Preferably the coring apparatus further comprises a radial bearing coupling the hollow drive train and the housing, the radial bearing comprising gaps forming part of the fluid path, such that fluid flow in the fluid path lubricates and/or cools the radial bearing.

Preferably the coring apparatus further comprises a thrust bearing coupling the hollow drive train and the housing, the thrust bearing comprising gaps forming part of the fluid path, such that fluid flow in the fluid path lubricates and/or cools the thrust bearing.

Preferably the seal directs fluid to the fluid flow path and isolates the core barrel from fluid in the fluid flow path.

Preferably in use the coring apparatus is coupled to a drill string housing, such that rotation of the drill string housing rotates the coring apparatus housing and the turbine stator, and the fluid flow path of the coring apparatus is coupled to the fluid flow path of the drillstring so that fluid flow through the drill string fluid flow path enters the coring apparatus fluid flow path and rotates the rotor relative to the rotating stator without rotating the core barrel.

Preferably the housing is rotationally isolated from the drill bit.

Preferably the drill bit comprises an outer shoe coupled to and rotatable by the housing and a coring bit coupled to and rotatable by the rotor of the turbine (preferably independent to the housing and shoe).

Preferably the housing is provided with a bent sub to allow directional control.

Preferably the fluid path exits at the bit to permit fluid flow in the path to exit and lubricate and/or cool the drill bit and return top hole via a borehole created by the coring apparatus.

In another aspect the present invention may comprise a steerable wireline retrievable coring apparatus for incorporation into a drillstring, comprising: a housing for coupling to a drill string housing, a bent sub coupled to said drill string housing, a drill bit, a turbine comprising a stator coupled to the housing and a rotor within the stator, the rotor coupled to rotate the drill bit, a core barrel through the turbine and in communication with the drill bit for capturing a core, a fluid path to the drill bit via the turbine to rotate the turbine, wherein the core barrel is rotationally isolated from the rotor and is fluidly isolated from the fluid path.

In another aspect the present invention may comprise a drilling apparatus comprising a drillstring with a housing, and a coring apparatus according to any preceding claim, wherein the housing of the coring apparatus is coupled to the housing of the drillstring such that rotation of the drill string housing rotates the coring apparatus housing and the turbine stator, and the fluid flow path of the coring apparatus housing is coupled to the fluid flow path of the drillstring so that fluid flow through the drillstring rotates the rotor relative to the rotating stator without rotating the core barrel.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7).

The term "comprising" as used in this specification means "consisting at least in part of". Related terms such as "comprise" and "comprised" are to be interpreted in the same manner.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

BRIEF DESCRIPTION OF DRAWINGS

Embodiments will be described, of which.

DETAILED DESCRIPTION OF PREFERRED EMBODIMENTS

Figure 1:
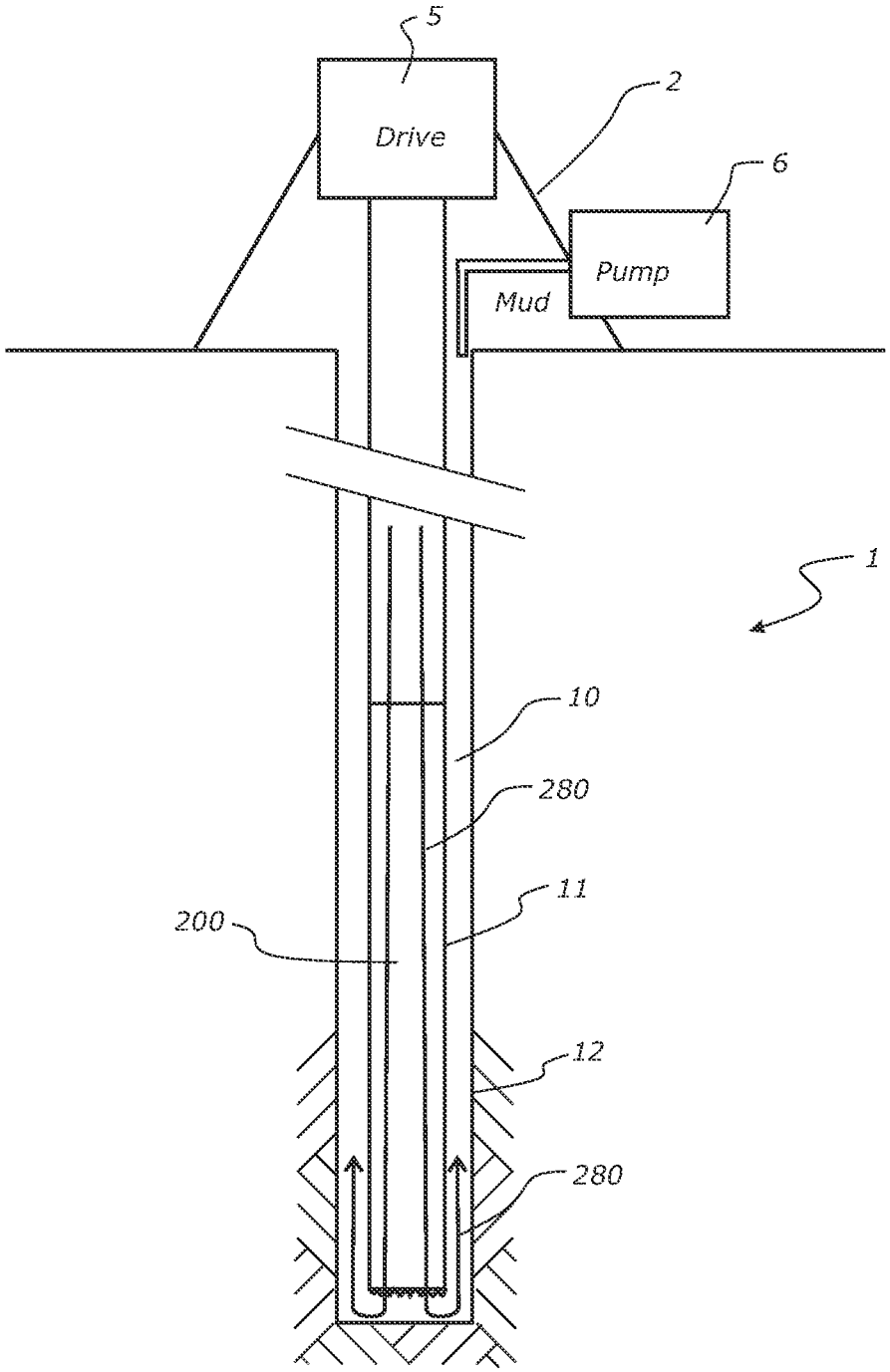
FIG. 1 shows a top hole drilling rig and drill string assembly for coring, the drill string assembly comprising a drill string housing (also casing or pipe) with a bottom hole assembly coring apparatus incorporated therein.

FIG. 1 shows a drilling apparatus 1 that incorporates coring apparatus 200 as described herein. The drilling apparatus comprises top hole infrastructure including a drill rig 2 for suspending and operating a drillstring 10 in or for drilling operations. The drillstring comprises a drillstring housing 11, comprising hollow drill casings (also called rods or pipes) that are coupled together by e.g. threading. A bottom hole assembly coring apparatus 200 is incorporated into the bottom part of the drillstring. In order to operate the drillstring for coring purposes, a top drive 5 is provided for rotating the drillstring housing 11 and pump 6 is provided for pumping drilling fluid (such as drilling mud) to operate the down hole assembly coring apparatus and provide lubrication/cooling for the drill bit and fluid lubricated bearings. A return fluid path occurs between the drillstring housing 11 and the borehole 12, which avoids the core sample. The drill rig 2 provides weight-on-bit via the drillstring to the drill bit. As the drilling apparatus 1 is operated, the drillstring advances the drill bit into the substrate and takes a core sample. A wireline retrieval assembly (see FIGS. 2 and 3A) is incorporated into the coring apparatus 200 and/or drillstring, which facilitates wireline retrieval of the core in a manner to be described.

First Embodiment

Figure 2:
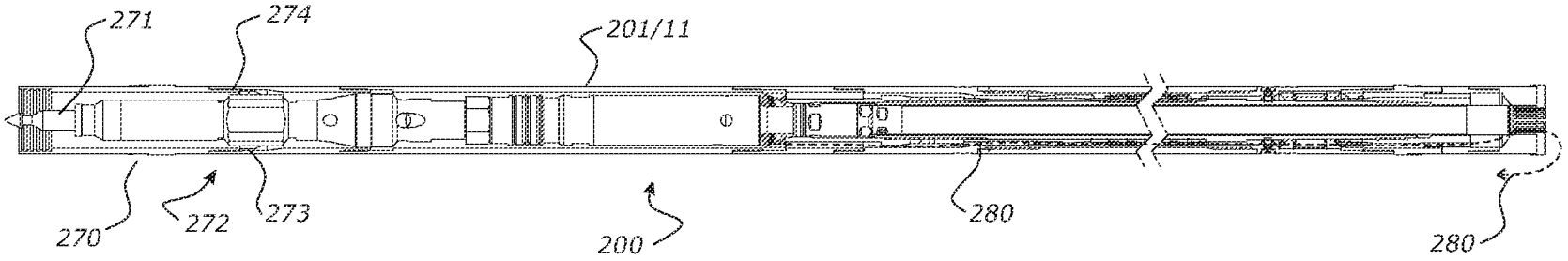
FIG. 2 shows a bottom hole assembly coring apparatus according to a first embodiment with half the drillstring casing removed to expose the components therein.
Figure 3:
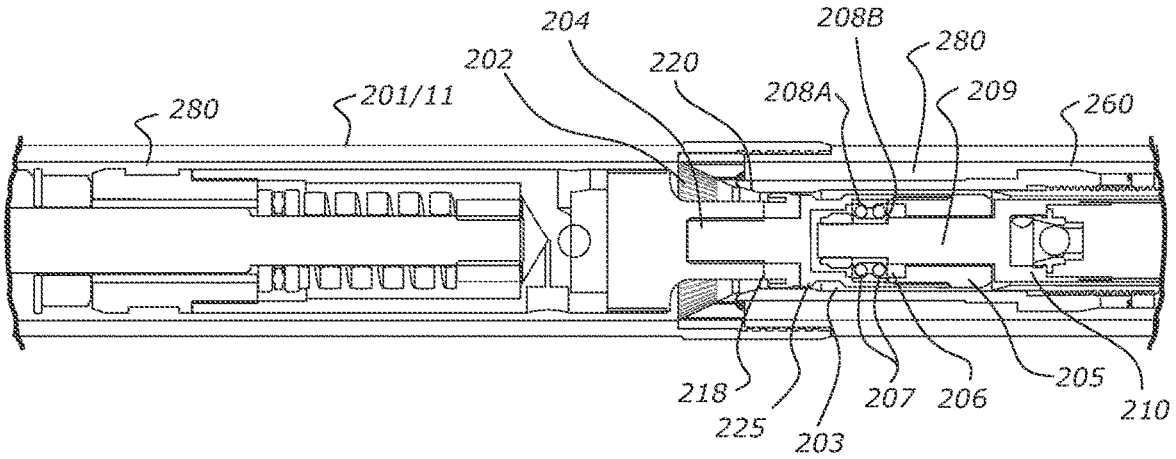
FIG. 3 shows the bottom hole assembly coring apparatus and cross sectional view in further detail.
Figure 3:
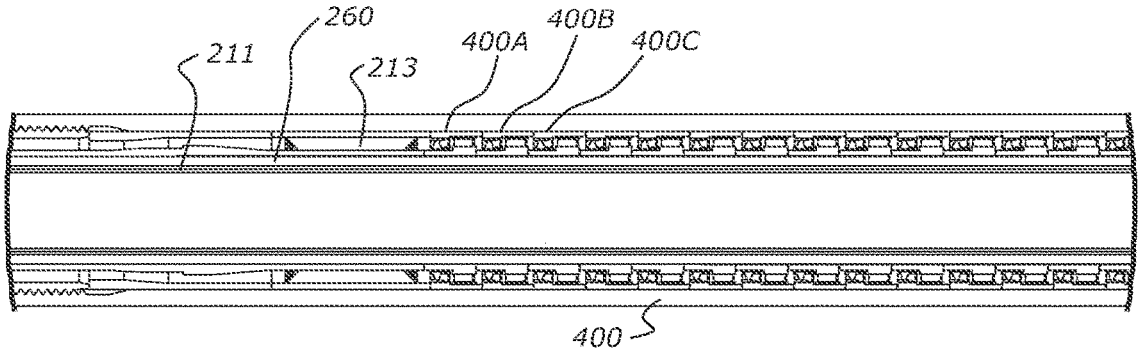
Figure 3:
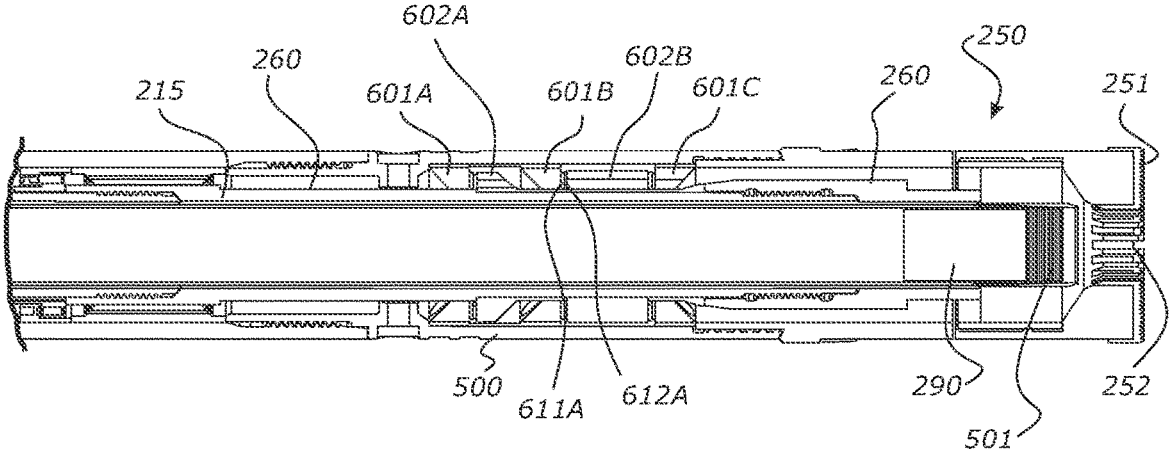
Figure 3A:
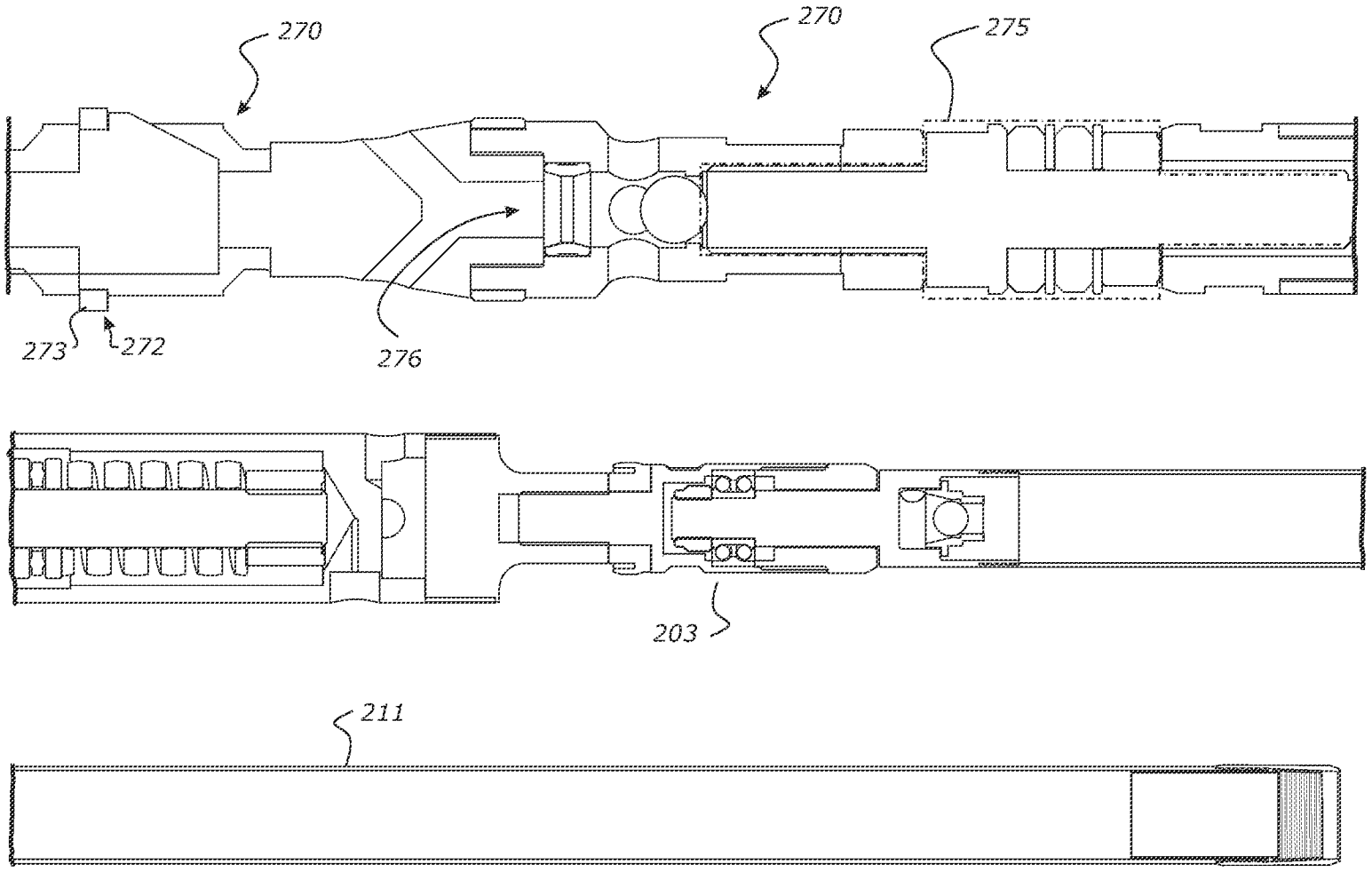
FIG. 3A shows a wireline retrieval assembly and core barrel extracted from the bottom hole assembly
Figure 4A:
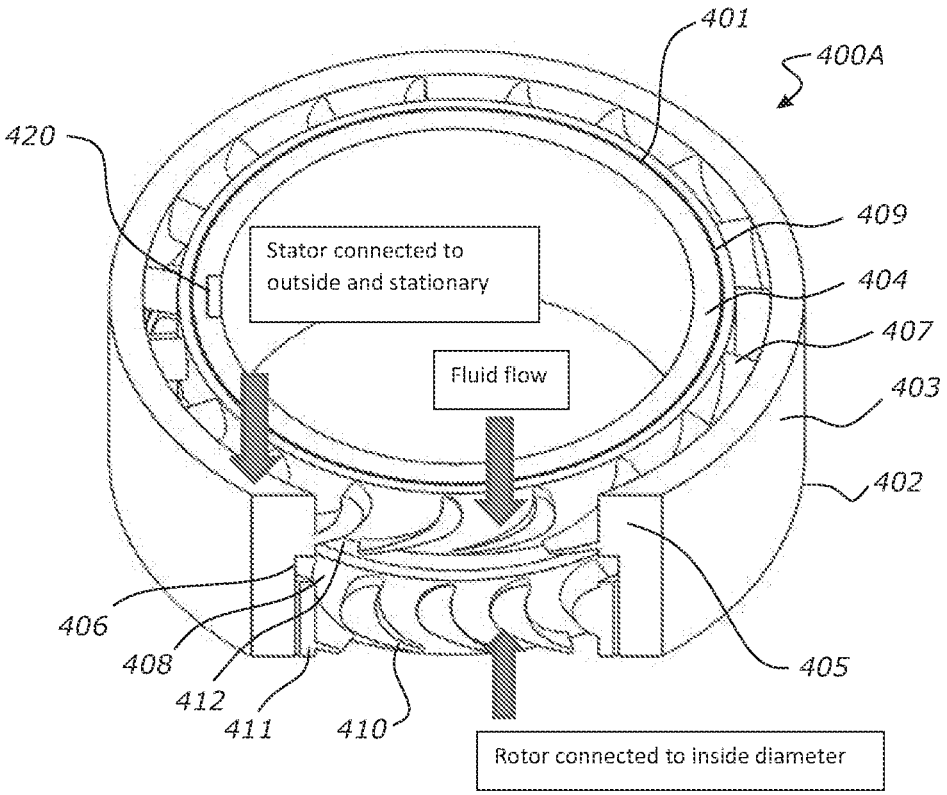
FIGS. 4A-4E show a single-stage of a turbine used in the bottom hole assembly.
Figure 4B:
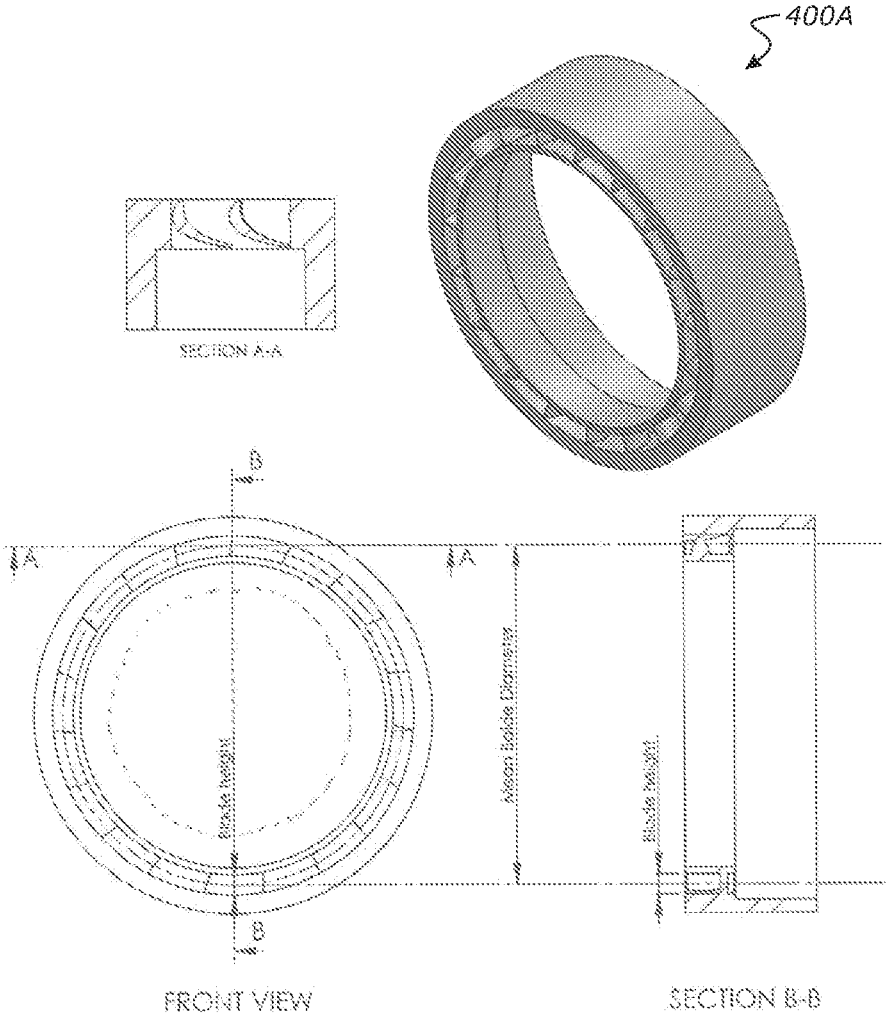
Figure 4C:
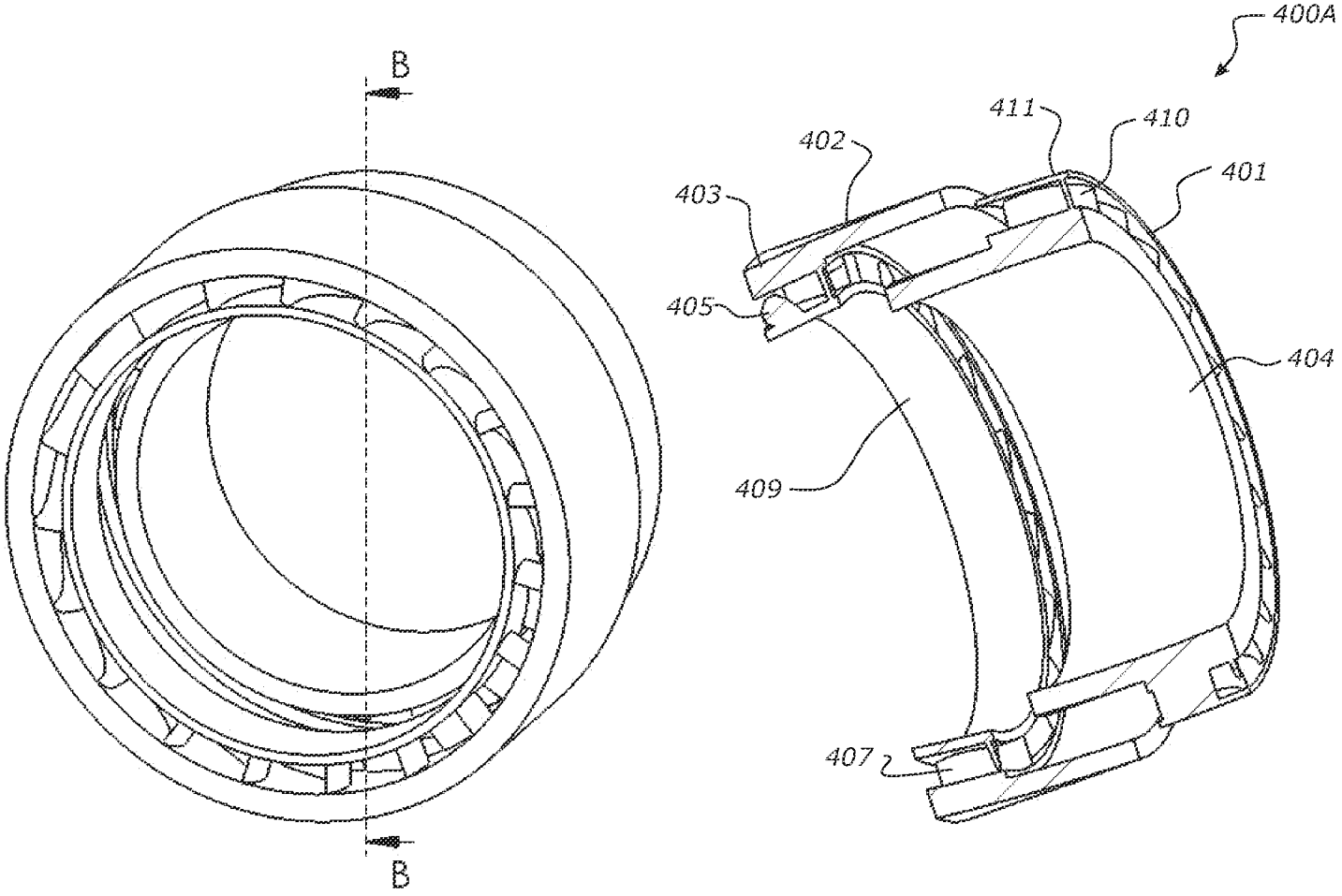
Figure 4D:
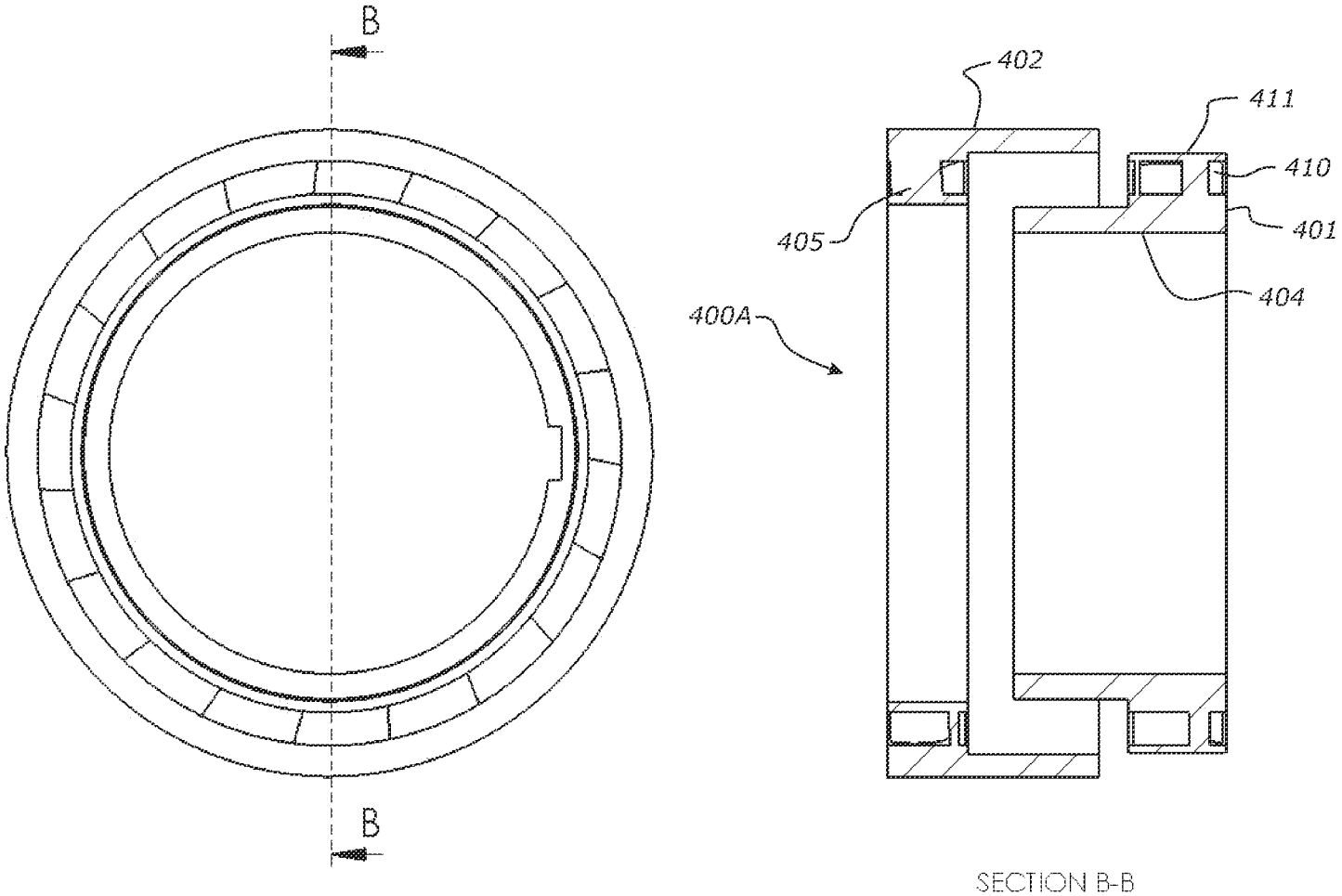
Figure 4E:
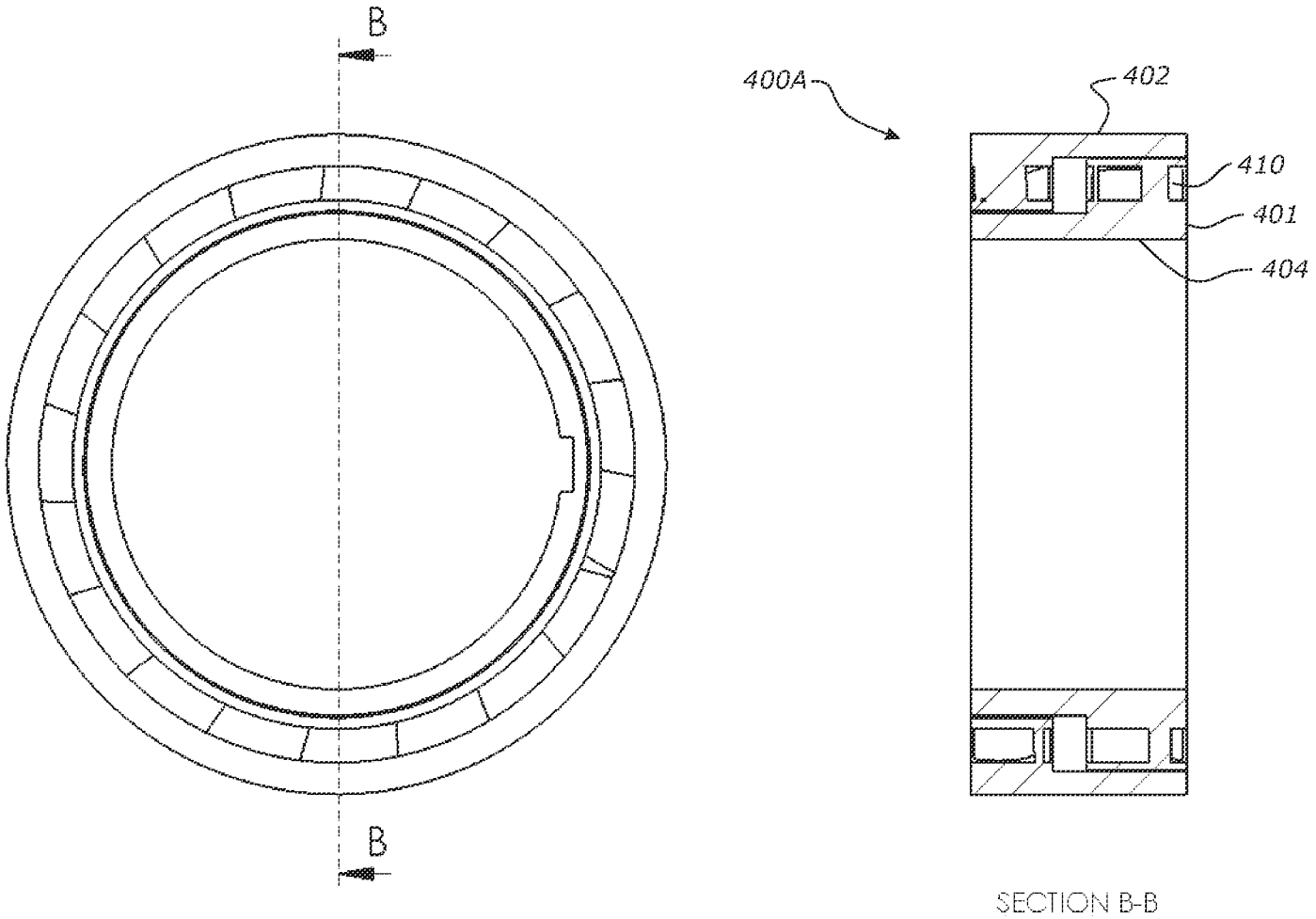

One embodiment of the wireline retrievable bottom hole assembly coring apparatus (hereinafter "coring apparatus") 200 is shown in FIGS. 2, 3 and 3A, whereby FIG. 2 shows in overview the coring apparatus, and FIGS. 3, 3A show the components of the coring apparatus in more detail in cross-section.

The coring apparatus 200 comprises a housing 201, formed of drillstring casings as described above, which are coupled to and form part of the drillstring housing 11, in use.

The coring apparatus facilitates wireline retrieval of a core without the need to withdraw the entire drillstring. To do this a wireline retrieval assembly 270 is provided—see FIGS. 2 and 3A. The wireline retrieval assembly might form part of the coring apparatus, or alternatively be separate from it. Irrespective, in use, the wireline retrieval assembly will be incorporated into the drillstring 11 and interact with the coring apparatus 200. The wireline retrieval assembly 270 will be described here separately to the coring apparatus with respect to FIG. 2 which shows the entire coring apparatus 200, and FIG. 3A which shows the wireline retrieval assembly 270 and core barrel 211 (to be described later) removed from the coring apparatus.

The wireline retrieval assembly 270 comprises an overshot assembly 271 (see FIG. 2) used to lower and retrieve the coring apparatus 200 via a grapple. Below the overshot system is a latch assembly 272 that couples/latches the core sampling assembly to or relative to the core housing 201/11. The latch assembly comprises extendible latch arms 273 (e.g. spring loaded latches) that engage with a shoulder 274 in the drill housing 11 that provides an abutment shown on the inside diameter of the drill housing. The latch assembly 272 constrains the coring apparatus (to be described below) from the upward axial movement. The latch assembly 272 is coupled to a wireline assembly swivel 275 (see FIG. 3A). The swivel is coupled to the coring apparatus proper 200. This swivel 275 rotationally decouples/isolates the rotational components of the coring apparatus 200 from the wireline retrieval assembly 270, so that the coring apparatus rotational components can rotate while still being held by the wireline retrieval assembly, itself which is latched to the drill housing. A fluid flow path 276 is provided for drilling fluid such as drilling mud, and is coupled to the fluid flow path of the coring apparatus to be described.

The coring apparatus 200 will now be described. The coring apparatus housing 201 will be referred from hereon as the drillstring housing 11 as it forms part of that housing in use. A mud filter 202 is provided in the drillstring housing 11 between the fluid flow path in the wireline retrieval assembly and a fluid flow path 280 of the coring apparatus. The wireline retrieval assembly is coupled to a coring apparatus/core barrel swivel assembly 203 that is provided within the drill housing 11. The swivel comprises a rotatable member/main body 225 with an annular rotatable shaft/casing with a bearing cavity 205 extending from a support shaft 204. The support shaft is coupled to the wireline retrieval assembly 270. An annular bearing assembly 206 (comprising bearings 207 in an annular bearing race 208A, 208B) is disposed concentrically within the annular bearing cavity 205. A core barrel support shaft 209 is disposed rotatably and concentrically within the bearing assembly 206. The outer bearing race 208A is disposed on the inner surface of the annular bearing cavity 205 and the inner bearing race 208B is disposed on the core barrel support shaft 209. An annular cavity 210 extends from the core barrel support shaft 209 and is coupled (e.g. by a thread) to a core barrel 211. The core barrel 211 extends concentrically within the coring apparatus/drillstring housing to a bit box 250.

A hollow rotatable drive train 260 extends through the coring apparatus housing 11 and couples to the drill bit 251. An upper internal annular housing 220 forming part of the rotatable hollow drive train 260 is provided within the drillstring housing 11 and concentrically around the swivel assembly 203. The upper annular housing 220 comprises multiple casings that are coupled together (e.g. by a thread). The core barrel swivel 203 is seated within the upper internal housing 220, such that the rotatable main body 225 of the swivel 203 is coupled to the upper internal housing 220. That is, the core barrel swivel 203 thus holds/suspends the core barrel 211 in the hollow drive train 260 via the support shaft 204 in a rotationally isolated/decoupled manner from the drive train 260. The swivel is seated within the upper internal housing via a static seal 218, which also prevents any fluid flow in the fluid path 280 entering through to the core barrel 211/core sample therein. The static seal (once seated) is slidably engageable with the upper internal housing 220 that is pressure activated by mud flow and can direct the fluid flow through the fluid path and through the turbines.

A turbine 400 (see also FIGS. 4A to 4E) is incorporated into the drillstring, and has a rotor 401 that is coupled to or forms part of the drive train 260. The turbine is a hollow axial turbine and can comprise one or more stages. Fifteen coupled stages are shown in FIG. 3 (three stages 400A to 400C being labelled as an example), while a single stage (400A by way of example) is shown in FIGS. 4A to 4E. Referring to FIGS. 4A to 4E, a single stage turbine 400A will now be described in further detail.

The turbine is a hollow centred impulse turbine. It comprises an inner rotor 401 and an outer stator 402 pair. The stator 402 comprises a hollow cylindrical/annular external stator ring 403 to support stator blades. Stator blades 407 are arranged on the internal annular surface/perimeter of the stator blade support 405 and extend radially inwards towards the rotor 401. A hollow cylindrical/annular internal stator ring 409 caps and supports the inward ends of the stator blades 407. The internal stator ring sits and rotates concentric with and external to the rotor 401.

Similarly, the rotor 401 comprises a hollow cylindrical/annular internal rotor ring 404. Rotor blades 410 are arranged on the external annular surface/perimeter of the rotor ring 404 and extend radially outwards to the stator 402. A hollow cylindrical/annular external rotor ring 411 caps and supports the outward ends of the rotor blades 410. The stator 402 and rotor 401 are brought together axially and arranged concentrically with the rotor inside the stator to provide the turbine assembly.

Each rotor ring 404 has a keying/locating/coupling arrangement to couple the rotor of one turbine stage e.g. 400B of the turbine to the rotors of the adjacent stages e.g. 400A, 400C of the turbine, so that the rotors are coupled and rotate synchronously. The coupling arrangement can comprise any suitable means, for example, a longitudinal locating aperture/recess 420 on the inner surface of each rotor. The rotors of each turbine stage can be stacked and aligned so that the locating apertures 420 align, and a metal locking bar or similar can be inserted into the longitudinal channel created by the aligned apertures 420. This bar locks/keys the rotors of adjacent turbines so that the rotors can rotate synchronously.

Fluid flow through the rotor/stator blades 410/407 causes the rotor 401 to rotate relative to and within the stator 402. Multiple stages 400A, 400B, 400C etc. could be axially coupled together to form the multiple stage turbine 400 incorporated in the drillstring housing. Herein, reference to turbine and components thereof can be a reference to one stage of the turbine, or the assembly of multiple stages, as context allows.

Referring back to FIGS. 2 and 3, the turbine is incorporated in the following manner. The upper internal housing 220 of the drive train is coupled to the top hole end of the rotor ring 404 of the first stage turbine 400A (via radial bearings 213 to be described below) of the turbine 400. The rotor/rotor ring 401/404 therefore forms part of the drive train 260, and rotation of the rotor 401 rotates the drive train 260, and therefore the drill bit 251 to which the drive train is coupled. The stator/stator ring 402/403 of the turbine (being the stator ring 403 of each turbine stage in the turbine) is coupled to the drillstring housing 11 (e.g. through axial compression), so that the turbine 400 sits in the drill string with the rotor 401 concentrically positioned inside the stator 402. The stator 402 therefore is coupled synchronously to the drillstring housing 11. The turbine 400 with its hollow centre through the rotor 401 sits concentrically around the core barrel 211. The rotor 401 is rotational supported concentrically within the drill string/stator by the radial bearings 213.

Figure 5:
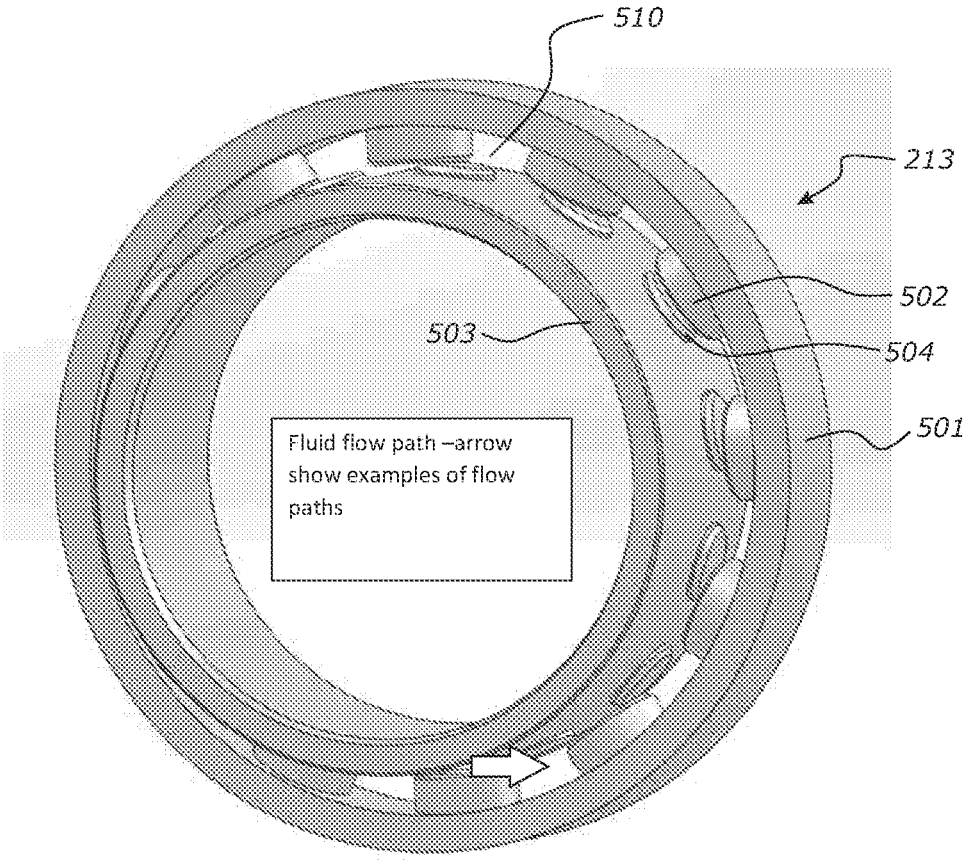
FIG. 5 shows a radial bearing used in the bottom hole assembly.
Figure 6A:
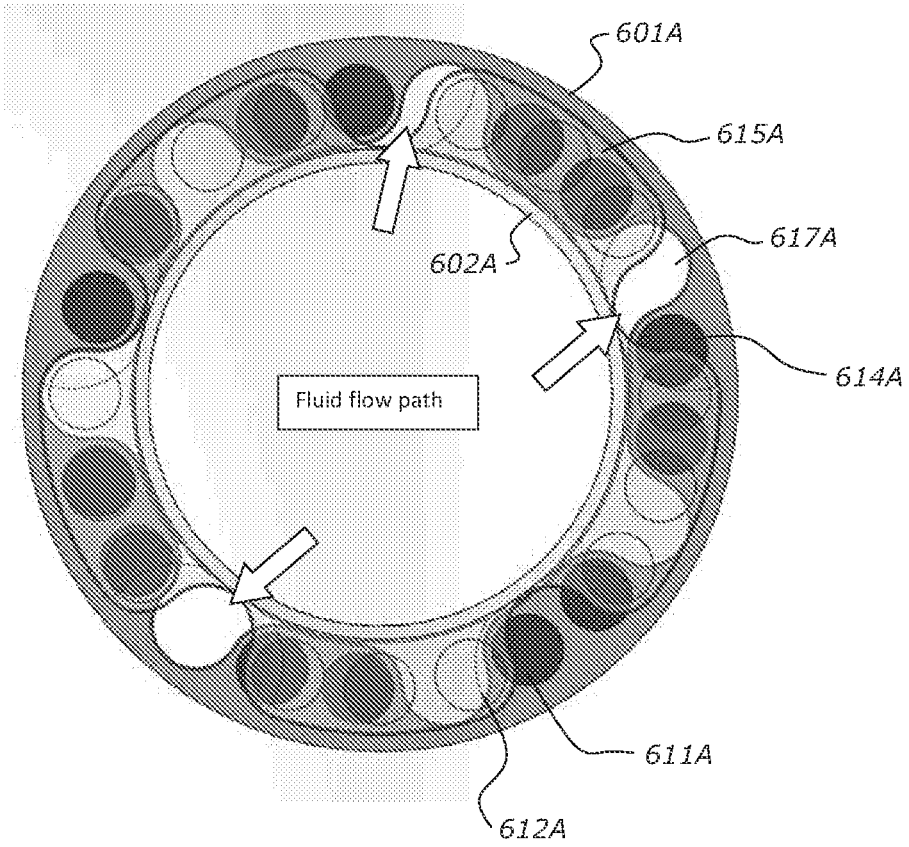
FIGS. 6A to 6E show various views of a thrust bearing arrangement according to a first embodiment.
Figure 6B:
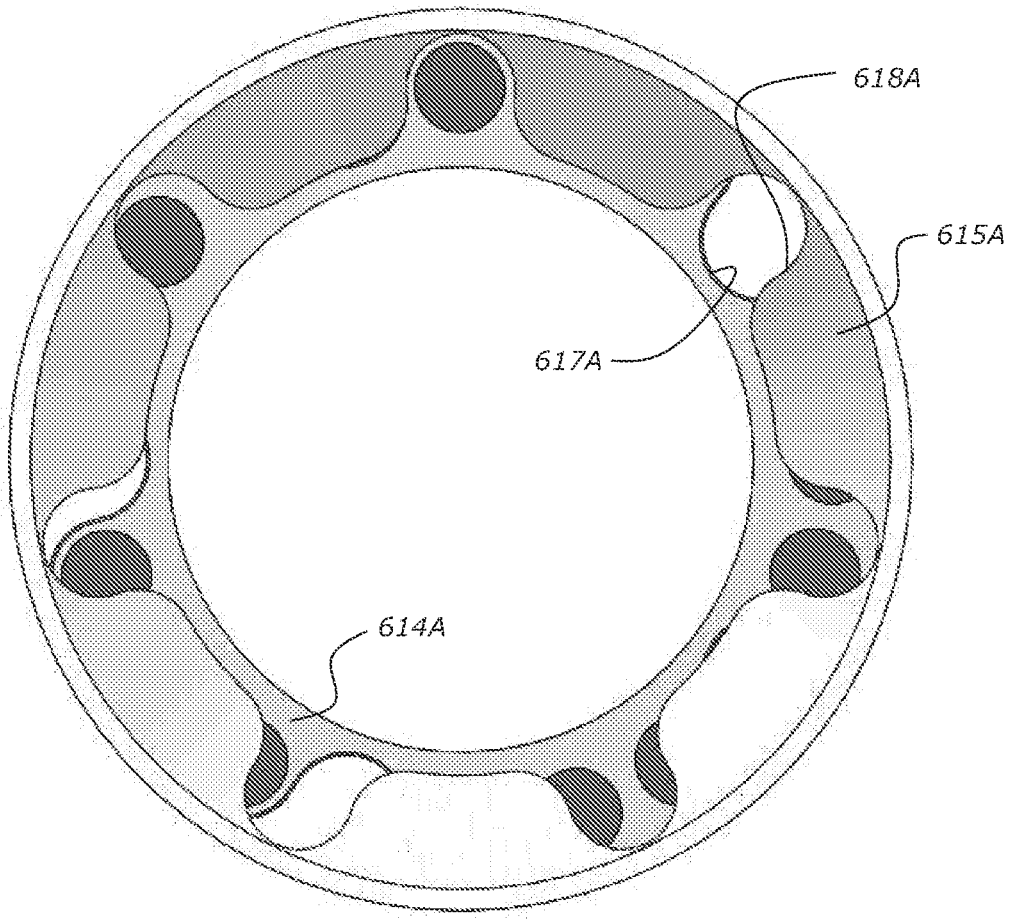
Figure 6C:
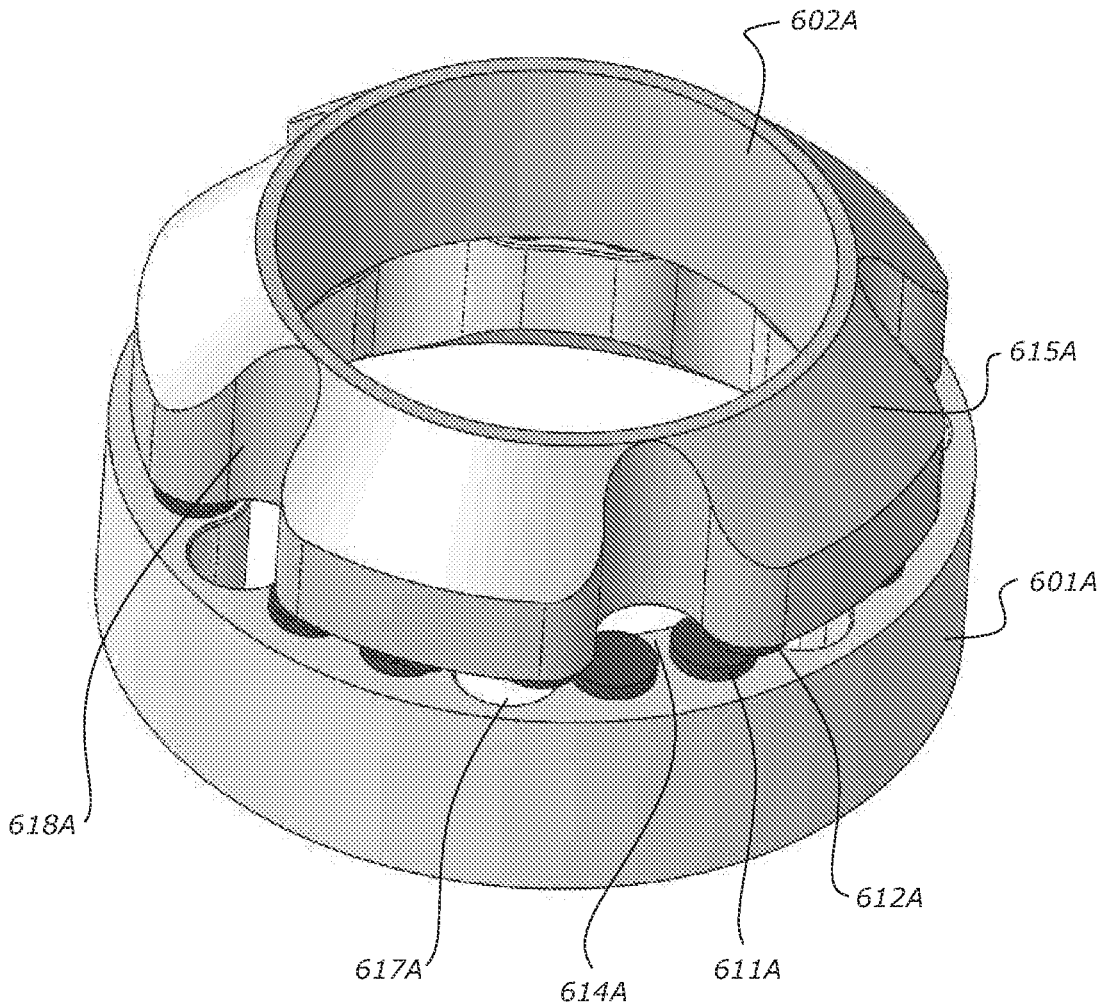
Figure 6D:
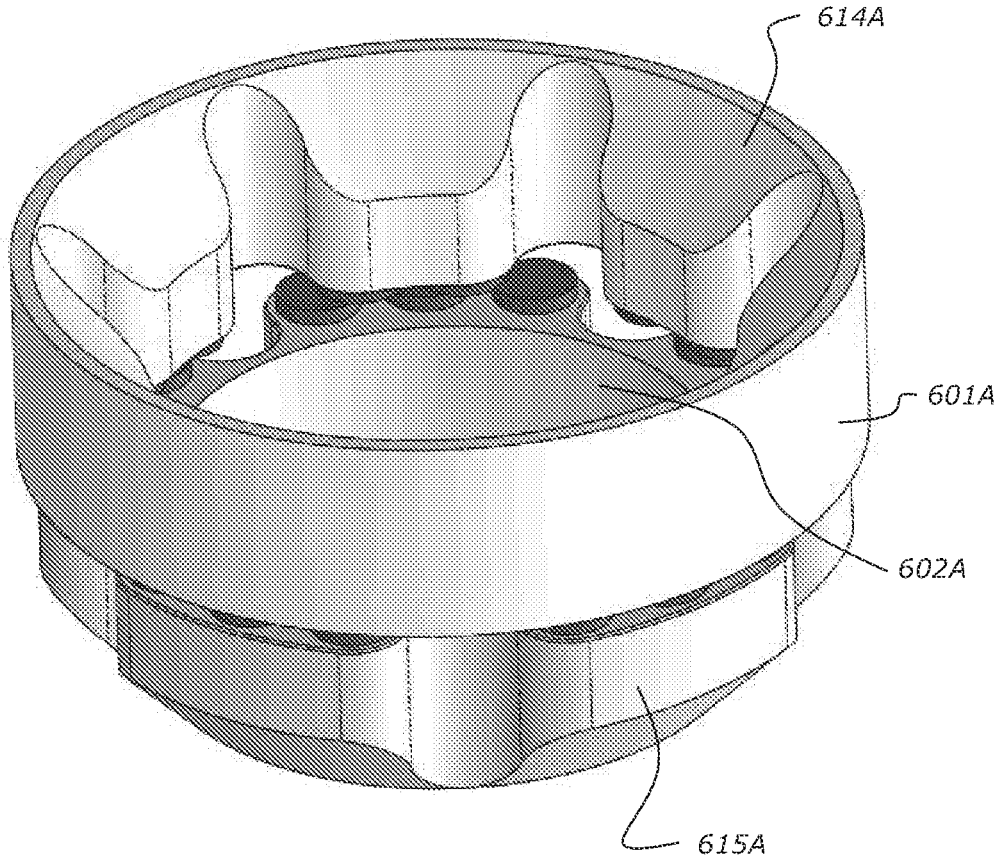
Figure 6E:
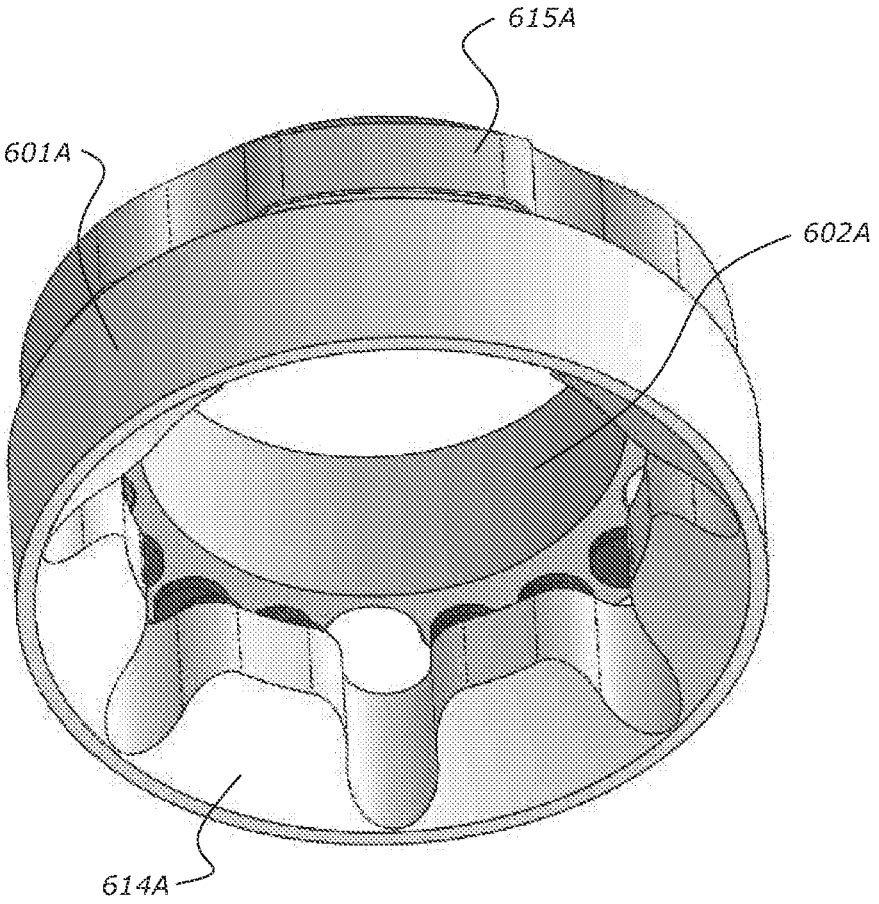
Figure 7A:
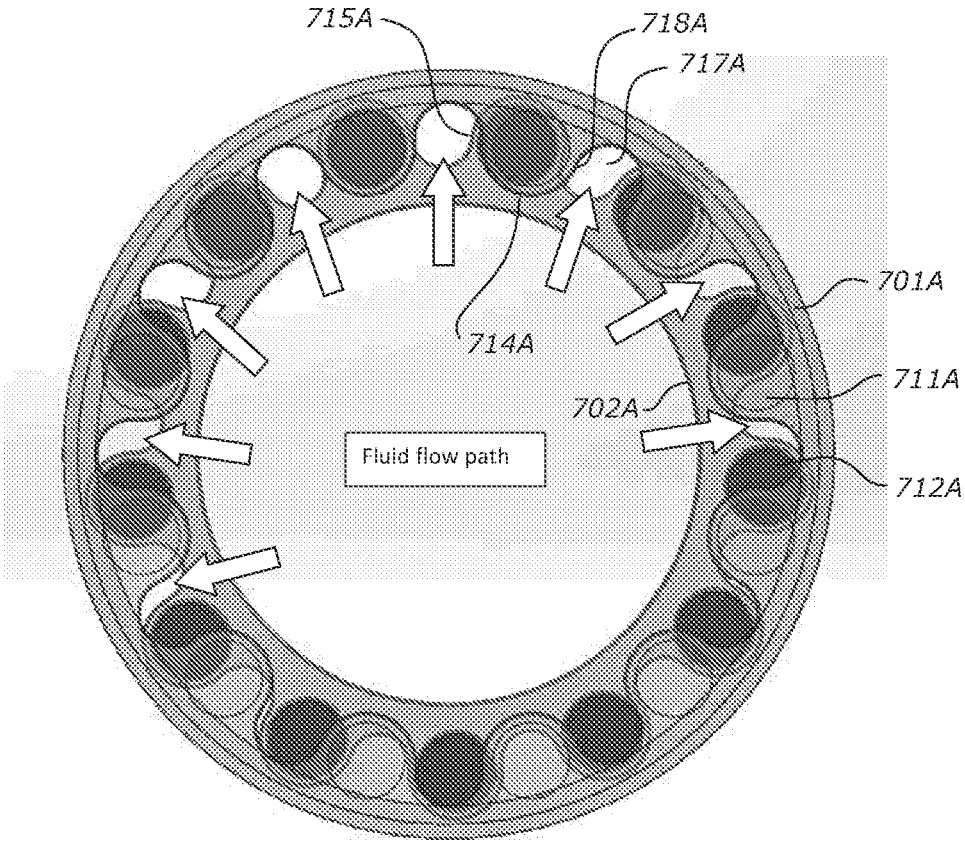
FIGS. 7A to 7D show various views of a thrust bearing arrangement according to a second embodiment.
Figure 7B:
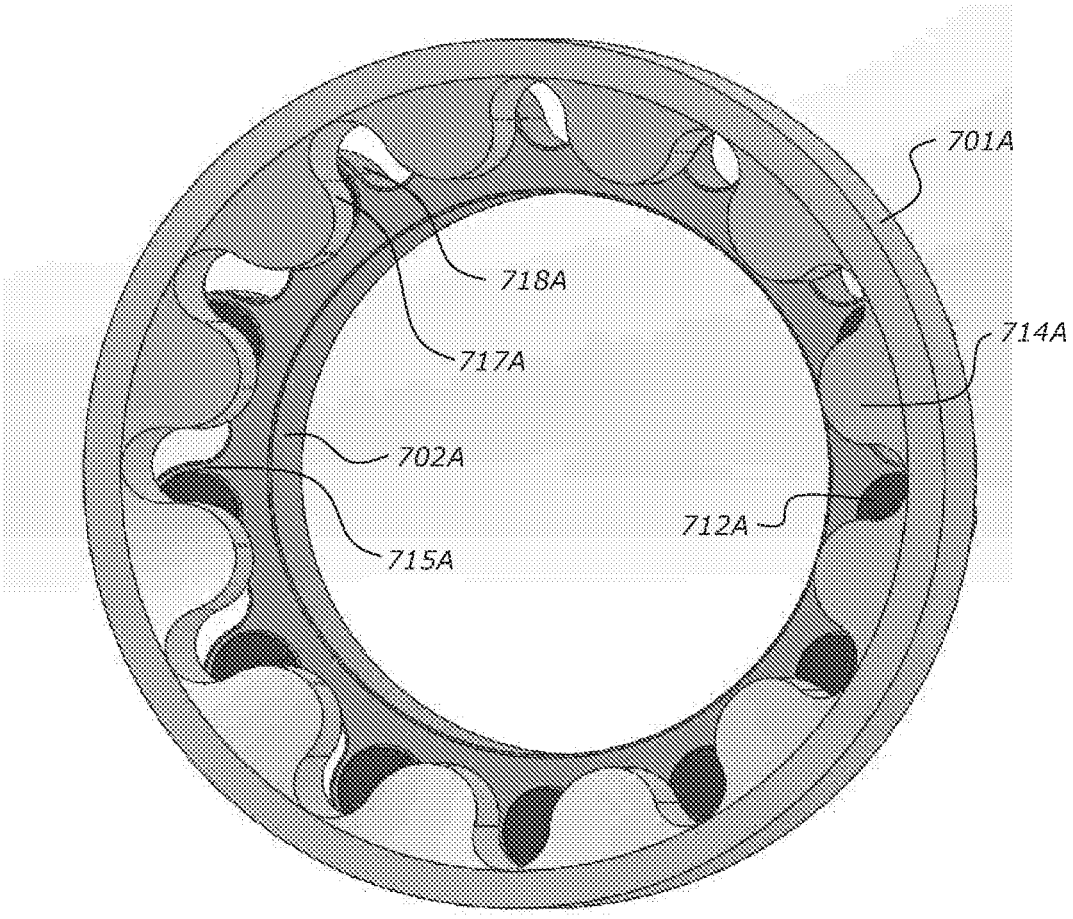
Figure 7C:
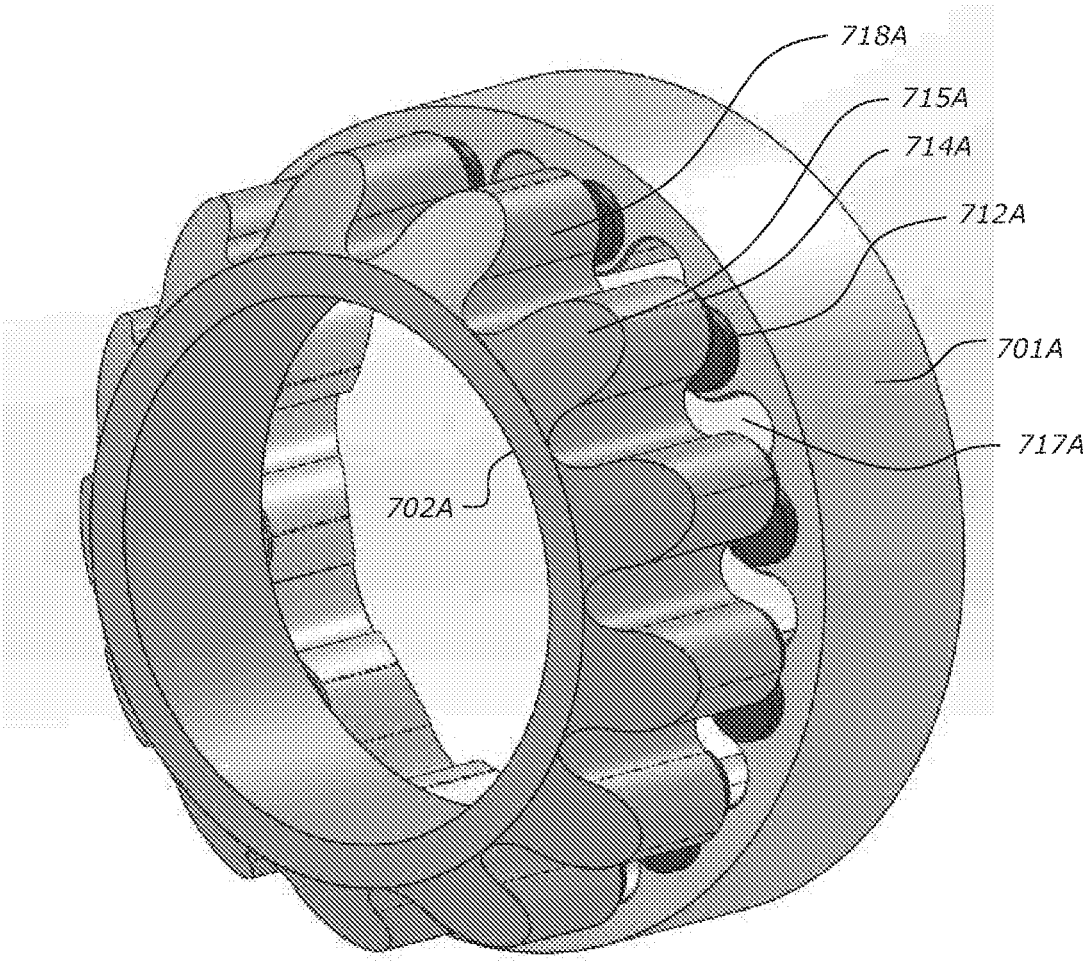
Figure 7D:
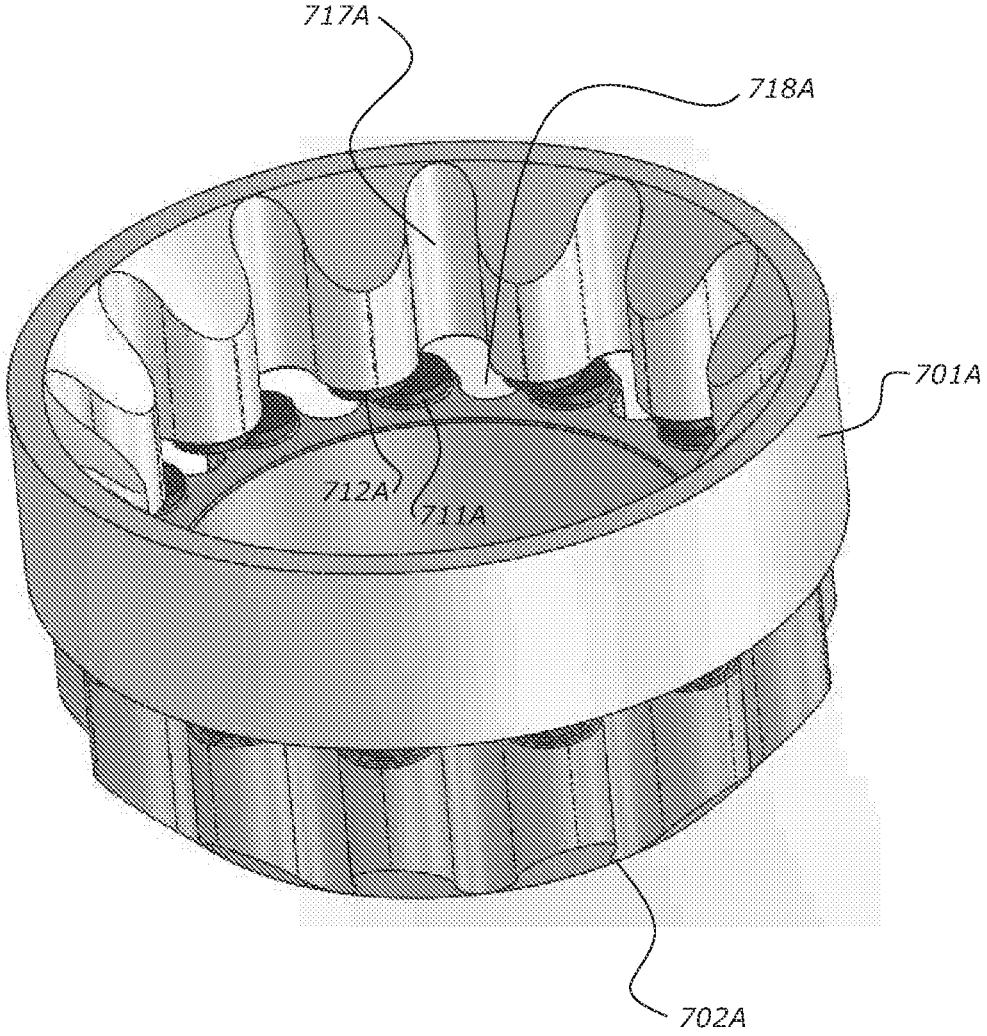

Referring to FIG. 5, the radial bearings 213 are fluid lubricated and comprise an outer bearing (hollow cylindrical/annular) ring 501, the down hole annular perimeter of which is coupled to the top hole end of the stator 402 (that is, the stator ring 403 of the first turbine 400A in the stack), and the external surface of which is coupled to the internal surface of the drillstring housing 11. Cylindrical bearings e.g. 502 (such as PDC inserts) are arranged on the internal annular surface/perimeter of the outer bearing ring 501 and extend radially inwards.

The radial bearings 213 also comprise an inner bearing (hollow cylindrical/annular) ring 503, the up hole annular perimeter of which is coupled to the upper internal housing 220, and the downhole annular perimeter of which is coupled to a top hole end of the rotor 401 (that is, the rotor ring 404 of the first turbine 400A in the stack). Cylindrical bearings 504 (such as PDC inserts) are arranged on the external annular surface/perimeter of the inner bearing ring 503 and extend radially outwards.

The rotor bearings 504 and the stator bearings 502 extend radially towards each other and bear against each other in a sliding arrangement when there is relative rotation between the inner rotor ring 404 and the outer stator ring 403 due to rotation of the turbine 400. This allows the turbine to rotate and keeps the turbine rotor/stator concentrically arranged in the drillstring housing 11. There are gaps 510 between the rotor and stator bearings to form part of the fluid flow path 280. Fluid in the fluid flow path can travel through the gaps 510 and cool and/or lubricate the bearings. The fluid flow path will be described in more detail later.

A lower internal annular housing 215 is provided within the drillstring housing 11 and is coupled (e.g. by a thread) to the down hole end of the turbine rotor 401 ((that is, the rotor ring 404 of the last turbine stage in the stack). The lower internal annular housing forms part of the hollow rotatable drive train 260. The lower internal annular housing comprises multiple casings that are coupled together (e.g. by a thread) to concentrically surround the core barrel 211 and extend downhole towards the bit box 250. The internal annular housing is splined to the bit box 250 and the end thereof can abut the back of the bit box to provide weight-on-bit. The drillstring housing 11 is rotationally decoupled/isolated from the bit box.

The lower internal annular housing is coupled via a spline to the bit box 250 carrying a (wide kerf) drill bit 251, such as a diamond impregnated drill bit. The core barrel 211 extends through the lower internal annular housing 215, itself having a core catcher 501 located on the inside diameter of the core barrel. The core barrel, the core catcher and core sample are rotationally isolated by swivel 203.

The upper internal annular housing 220, turbine rotor 401 and lower internal annular housing 215 assembly form the drive train 260, which is an internal rotatable assembly that concentrically surrounds the core barrel 211 and sits concentrically in the drillstring housing 11. The internal rotatable assembly is a drive train 260 to rotatably couple the turbine 400 (that is, the rotor/output of the turbine) to the bit box 250/drill bit 251. The core barrel is rotationally isolated from the drive train 260 by the swivel assembly 203, so that rotation of the drive train 260 does not disturb the core barrel 211 and core sample 290 within it, retaining its integrity/keeping it intact. Further the core is not degraded by vibration from the drive train and erosion from the drilling fluids from the fluid pathway has been significantly diminished, if not removed entirely. The drive train 260 can rotate relative to the drillstring housing 11 in a manner to be described later.

A thrust bearing assembly 500 is provided between the lower internal annular housing 215 and the drillstring housing 11 to provide a sliding/rotational bearing arrangement between the two so weight-on-bit provided to the drillstring housing 11 from the drill rig can be transferred to the lower internal annular housing 215 and through to the bit box 250 and drill bit 251.

The thrust bearing 500, which is shown in situ in FIGS. 2 and 3, comprises three bearing stages (e.g. 601A/602A, 601B/602B, and 601C). Stage one 601A/601B is shown in detail in FIGS. 6A to 6E. The other stages two and three of the thrust bearing have an equivalent structure. FIGS. 7A to 7D show an alternative embodiment of stage one of the thrust bearing, which could be used instead and will be described later.

FIGS. 6A to 6E show various views of a first embodiment of stage one 601A/602A of the thrust bearing. The description of those Figures also applies to stages two and three where appropriate. Stage one comprises an outer bearing (hollow cylindrical/annular) ring structure 601A, which is coupled to the drillstring housing 11 and an inner bearing (hollow cylindrical/annular) ring structure 602A, which is coupled to the lower internal annular housing 215 and concentrically engages with the outer bearing ring structure 601A via cylindrical bearings 611A, 612A, such as PDC inserts (or equivalent bearing material that can withstand harsh, drilling fluid environments), on both the inner 602A and outer ring 601A. The PDC bearings 611A, 612A slidably interact when the inner bearing ring structure 602A rotates relative to the outer bearing ring structure 601A, and transfer weight-on-bit force from the drillstring housing 11 to the lower internal annular housing 215. The downward hydraulic pressure from the drilling fluid across the turbine blades creates a thrust force which in conjunction from the upward pressure (which results when the drill bit is pushed into the formation) needs to be controlled via the thrust bearings, while still allowing low friction rotation. When modest weight on bit is applied to the drill bit via the drill rig and thrust bearings, the drill bit spins at the combined speed of the drill string housing and turbine.

The thrust bearing 500 will be described in more detail with reference to FIGS. 2, 3, 6A to 6E. The outer ring structure 601A of stage one comprises an annular ring of lugs e.g. 614A extending radially inwardly from the internal surface of the outer bearing ring structure 601A. The cylindrical bearings 611A are disposed on the lugs—in this embodiment, three cylindrical bearings per lug. The gaps 617A between lugs provide fluid channels forming part of the fluid flow path 280 to be described later. The inner ring structure 602A of stage one comprises an annular ring of lugs e.g. 615A extending radially outwards from the external surface of the inner bearing ring structure 602A. The cylindrical bearings 612A are disposed on the lugs—in this embodiment, three cylindrical bearings per lug. The gaps 618A between lugs provide fluid channels to forming part of the fluid flow path 280 to be described later.

The lugs 614A on the outer bearing ring structure 601A extend radially towards the inner bearing ring structure 602A, and vice versa the lugs 615A on the inner bearing ring structure 602A extend radially towards the outer bearing ring structure 601A. This configuration means that the lugs 615A/614A of the inner/outer rings 602A/601A are longitudinally in the same annular space. This positions the cylindrical bearings 611A/612A such that as the outer ring 601A rotates relative to the inner ring 602A, the respective bearings 612A, 611A slide across each other. The spacings of the bearings/lugs is such that an outer ring bearing 611A is always in contact with an inner ring bearing 612A.

FIGS. 7A to 7D show the arrangement of the second embodiment of one stage of the thrust bearing. The arrangement is similar to that in FIGS. 6A to 6E. It has an outer bearing ring structure 701A and an inner ring bearing structure 702A coupled to the drillstring housing 11 and lower internal annular housing 215 respectively as describe previously. The difference in this embodiment is there are more, but smaller, lugs 715A/714A arranged annularly around the inner ring 702A and outer ring 701A. A single cylindrical bearing 711A/712A is disposed on each lug. The gaps 717A/718A between lugs 714A/715A provide fluid channels to forming part of the fluid flow path 280 be described later.

The thrust bearing 500 comprises three stages, the first stage 601A/602A as described with reference to FIGS. 6A to 6E, and 7A to 7D above. The second and third stages comprise inner 602B and outer ring 601B, 601C structures similar to that describe for stage one, except that for stage two and three there is only one combined inner ring structure 602B. The inner ring structure of stage two/three has cylindrical bearings on both sides of the lugs, facing in opposing (uphole and downhole) longitudinal directions. In effect, it is like placing two inner ring structures of stage one back to back, and coupling them to the lower internal annular housing 215. The outer rings structures 6016/601C of stages two and three are the same as described for stage one, except that the outer ring structure 601C of stage three is arranged so that the cylindrical bearings face longitudinally up hole so they can bear against the down hole facing cylindrical bearings of the stage three inner rings structure 602B.

The annular rings of lugs/cylindrical bearings for the outer ring structures of stages one, two and three are spaced axially along the drill string housing. The two annular rings of lugs/three arrays of cylindrical bearings for the inner ring structures of stages one, two and three are spaced axially along the lower internal annular housing 215. In stages one and two, the cylindrical bearings on the respective outer bearing ring structures are disposed on a down hole face of the lug 604 and extend down hole, so that they bear against the corresponding cylindrical bearings of stages one and two of the respective inner ring structures. In stage three, the cylindrical bearings of the respective outer bearing ring structure are disposed on an up hole face of the lug and extend up hole, so that they bear against the corresponding cylindrical bearings of stage three of the inner ring structure. The cylindrical bearings of stages two and three are therefore on opposing directions and face away from each other. In stages one and two, the cylindrical bearings are disposed on a up hole face of the lug and extend up hole. In stage three, the cylindrical bearings are disposed on an up down face of the lug and extend down hole. The cylindrical bearings of stages two and three are therefore on opposing directions and face away from each other.

The stages of the inner and outer ring structures 602, 601 can be integrally formed together, or can be separate stages that are coupled together to form the overall outer bearing ring structure.

The upper and lower annular housings 220, 215 of the drive train are radially dimensioned so that their external surfaces are spaced from the internal surface of the drillstring housing to create an annulus; and the rotor blades and stator blades are positioned in communication with the annulus, such that in combination there is a fluid flow path 280 (for drilling fluid, preferably mud) between the internal rotatable assembly (drive train) and the drillstring housing extending from the mud flow filter 202 (which stops potentially damaging particles from entering the turbine) to the drill bit 251. The mud flow path extends from up hole portions of the drillstring through the wireline retrieval assembly fluid path 276, through the mud flow filter 202, through the spacing between the upper internal annular housing and the drillstring housing. The static seal 218 surrounds the swivel assembly support shaft 204 and sits between the support shaft and the internal surface of the uphole end of the upper internal annular housing 220. This prevents mud flow getting into the swivel assembly 203 itself and into the core barrel 211, to protect the integrity of the core sample 270 from mud flow and to direct the fluid flow into the fluid flow path 280. The seal 218 is a static seal. The swivel assembly is able to isolate the seal 218 from high rotational speeds as well as being a slideably engagable (to allow deployment/retrieval via wireline) high pressure seal. The seal is energised by the high pressure fluid. This means the drilling fluid is diverted through the turbine blades—thereby increasing mechanical power (speed and torque) to the drill bit.

As can be seen in FIG. 5, the cylindrical bearings in the radial bearing assembly have gaps 510 therebetween that are situated in fluid communication with and form part of the fluid flow path to allow for fluid flow. The fluid flow can also cool and lubricate the bearings. The fluid flow path 280 continues between the rotor and stator turbine blades and through the spacing between the lower internal annular housing 215 and the drill string. The fluid flow path continues down through the thrust bearings 280. Referring to FIGS. 6A to 6E and 7A to 7D, the gaps 617A/618A between lugs on the three stages that carry the cylindrical bearings on the inner and outer ring structures provide for fluid flow channels between the lugs. These fluid flow channels are in communication with and form part of the fluid flow path 280. The fluid flow through the gaps 617A/618A can also cool and lubricate the bearings. The lugs/gaps are arranged and dimensioned such that irrespective of the relative angle of rotation between the lugs of the outer ring and the lugs of the inner ring structure, there is always some overlap between the channels on the outer ring structure and the channels on the inner ring structure so there is always a fluid flow path, as well as allowing sufficient cooling of the preferably PDC bearing surfaces.

For example, referring to FIGS. 6A to 6E, fluid flow paths 617A/618A between lugs 614A/615A are shown for one relative rotation orientation between the inner and outer ring structures. FIGS. 7A to 7D shows the alternative thrust bearing embodiment with one relative rotation orientation between the inner and outer ring structures that allows for fluid flow paths.

More generally, to create a fluid flow path through the bearings, substantial cut outs (such as the gaps between lugs) can be provided in the bearings as detailed below while still keeping as many PDC inserts in an even distribution and in contact around the pitch circle diameter of the bearing at any time. This is achieved by having a mismatch in the number of PDC inserters and cut-out (gaps between lugs) on the fixed and rotation pieces of the bearing. In this case a difference of one in the number of lugs and cuts outs with at least two inserts positions adjacent without a cut out between them. For example, as shown in FIGS. 6A to 6E there is still a mismatch between the number of PDC inserts and also the number of cut out slots. But in this arrangement the loading distribution is even with the contact patch biased more to one half of the bearing. A solution to this would be to have a tandem set of bearings timed together in such a way as to have the contact bias positioned opposite each other.

The fluid flow path 280 continues into the bit box 250 and through the drill bit fluid flow channels 252 to the drill bit/boreface. The return mud flow path is between the outer surface of the drill casing and the bore.

In summary, the fluid flow path 280 comprises/is formed from a fluid flow channel in the upper drillstring and wireline retrieval assembly 276, the mud filter 202, the annulus between the upper internal housing and the drillstring housing, the gaps in the radial bearing, the gaps between the rotor and stator blades, the annulus between the lower internal housing and the drillstring, the gaps in the thrust bearing and channels in the drill bit. This provides a contained downhole fluid path for drilling mud that drives the turbine, cools and lubricates the bearings, lubricates and cools the drill bit, and flushes cuttings. The mud is preferably recycled. The fluid flow path may also be considered to comprise the return path annulus between the bore hole and the drillstring casing which allows for drilling mud to return to the surface with cuttings. The weight on bit keeps the drill bit against the bore face which prevents drilling mud going into the core—it urges the drilling mud back up around the bit and up the bore hole. The drilling mud takes the path of least resistance up the borehole/drillstring annulus. The down hole fluid flow path and uphole fluid flow path is isolated from the core barrel and core sample therein to protect it from drilling mud and mechanical rotation.

Operation of the drill string will now be described. Weight-on-bit is provided, which is transferred down through the drillstring housing 11, through the thrust bearings 500 into the lower internal annular housing 215 and on to the drill bit 251 via the bit box 250. The drillstring housing 11 is rotated from the top hole drill rig assembly.

Drilling mud is provided to the drillstring fluid flow path and travels down hole through the usual fluid flow path. It reaches and then exits the mud flow filter 202 and enters the fluid flow path 280 around the upper internal annular housing. The static seal 218 surrounds the swivel assembly 203 support shaft and sits between the support shaft and the internal surface of the uphole end of the upper internal casing. This prevents mud flow into the swivel assembly itself and into the core barrel, to protect the integrity of the core barrel and core sample from mud flow. The mud flow passes through the rotating openings in the radial bearings as described above. The mud flow continues through the turbine blades causing relative rotation between the rotor blades and the stator blades, to create rotation of the turbine and thereby the drive train 260. There is a pressure drop from the stator to rotor that generates the rotational power to the drill bit. The flow is accelerated in a stator and then passes through a rotor. In the rotor, the working fluid imparts its momentum onto the rotor that converts the kinetic energy to power output. Depending upon the power requirement, this process is repeated in multiple stages.

The turbine/drive train rotates the bit box via the spline (or other suitable arrangement) and thereby rotates the drill bit to drill into the bore face. The core barrel swivel 203 prevents the core barrel 211 rotating. The wireline retrieval assembly swivel 270 rotationally decouples the rotating drive train 260 from the wireline retrieval assembly 270 which is latched. Mud flow continues down the fluid flow path 280 through the rotating openings in the thrust bearings as described above and through the bit box via the drill bit fluid channels 252 to escape the internal cavity between the internal rotatable casing and to lubricate the drill bit and bore face to assist drilling. The drill bit cuts into the bore face and a core is captured in the core barrel as the drill bit advances. The fluid flow exiting the drill bit then returns up hole under pressure between the cavity between the external surface of the drill casing and the bore. The drill bit has a slightly larger diameter than that of the drillstring housing, creating an over cut which produces the return path annulus between the bore hole and the drillstring housing. Cuttings are flushed away from the boreface and up through the fluid flow return path with the fluid flow. The core barrel and core therein can be retrieved in the usual manner using an overshot grapple to extract the wireline retrieval assembly, swivel and attached core barrel from within the drive train, as shown in FIG. 3A.

The fluid flow through the turbine blades rotates the turbine (and in particular the rotor), and therefore the internal rotating casing and drill bit. The rotor blades (and therefore the rotor) rotate relative to the stator blades. As the stator blades are on the drill casing, the stator blades are also rotating. Therefore, the rotor actually rotates at an RPM which is the sum of the drill casing rotation RPM and the rotor RPM as a result of the mud flow. This provides a higher drill bit RPM than rotating the turbine with a rotationally static stator.

The stator portion of the turbine is synchronously coupled to the drill rods/drillstring housing—so that when the drill rods are rotated from surface (e.g. 1000 RPM) the rotor output speed of the turbine (e.g. 3,000 RPM) is combined such that then the drill bit speed is a combination of these inputs—being e.g. 4,000 RPM. Any suitable ranges of RPM can be utilised depending on the use to which the apparatus is to be applied to and taking into consideration any health and safety considerations at the top hole.

Second Embodiment

In the first embodiment, a wide kerf drill bit is used. The wide kerf bit is rotated by the turbine via the drive train. The drill housing rotates, but is rotationally isolated from the drill bit and does not directly rotate the drill bit.

Figure 8:
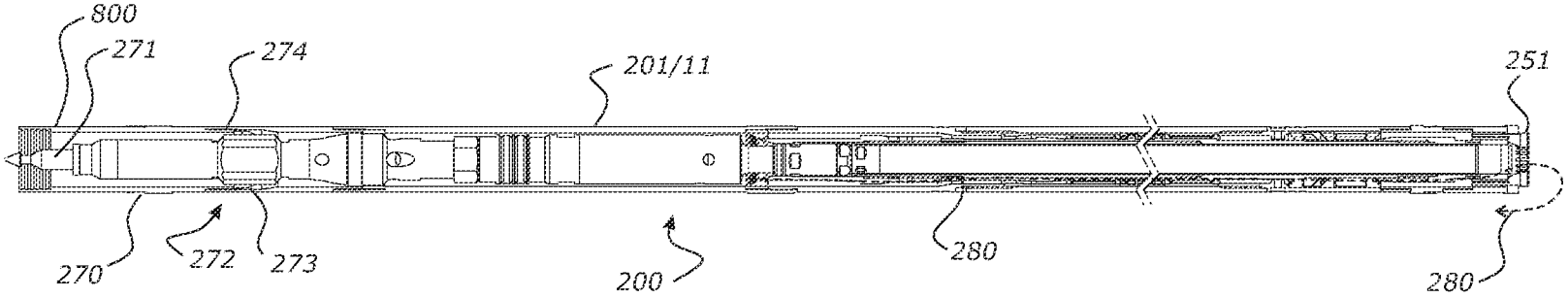
FIG. 8 shows a bottom hole assembly coring apparatus according to a second embodiment with half the drillstring casing removed to expose the components therein.
Figure 9:
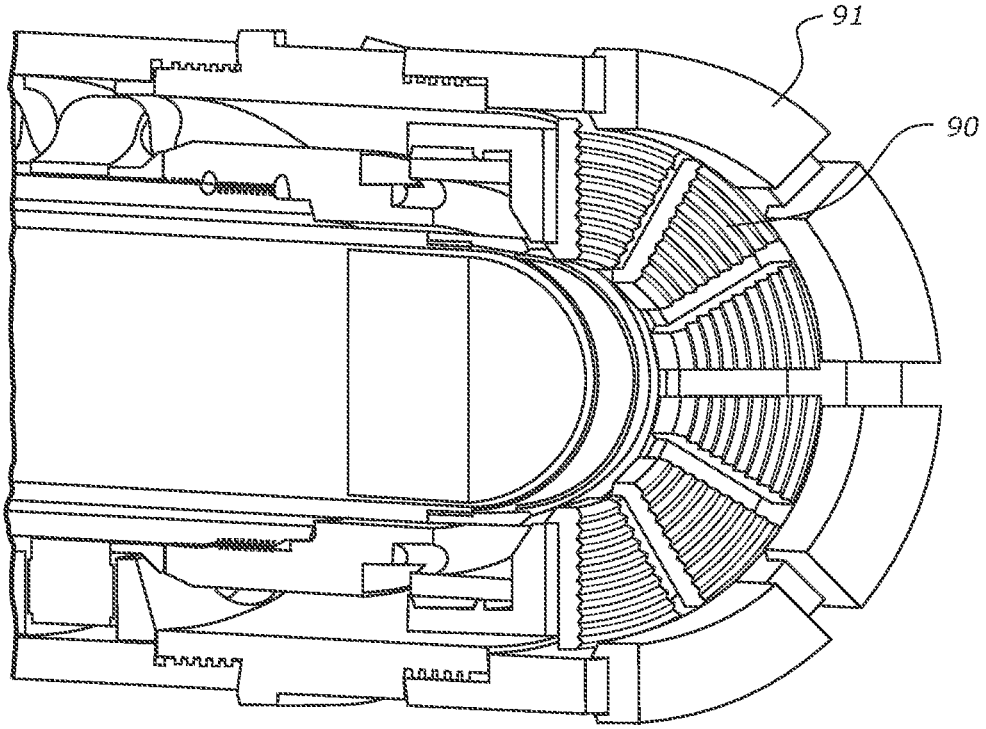
FIGS. 9 and 10 show cross-sectional and full perspective views of a drill bit assembly for the second embodiment of the bottom hole assembly coring apparatus.
Figure 10:
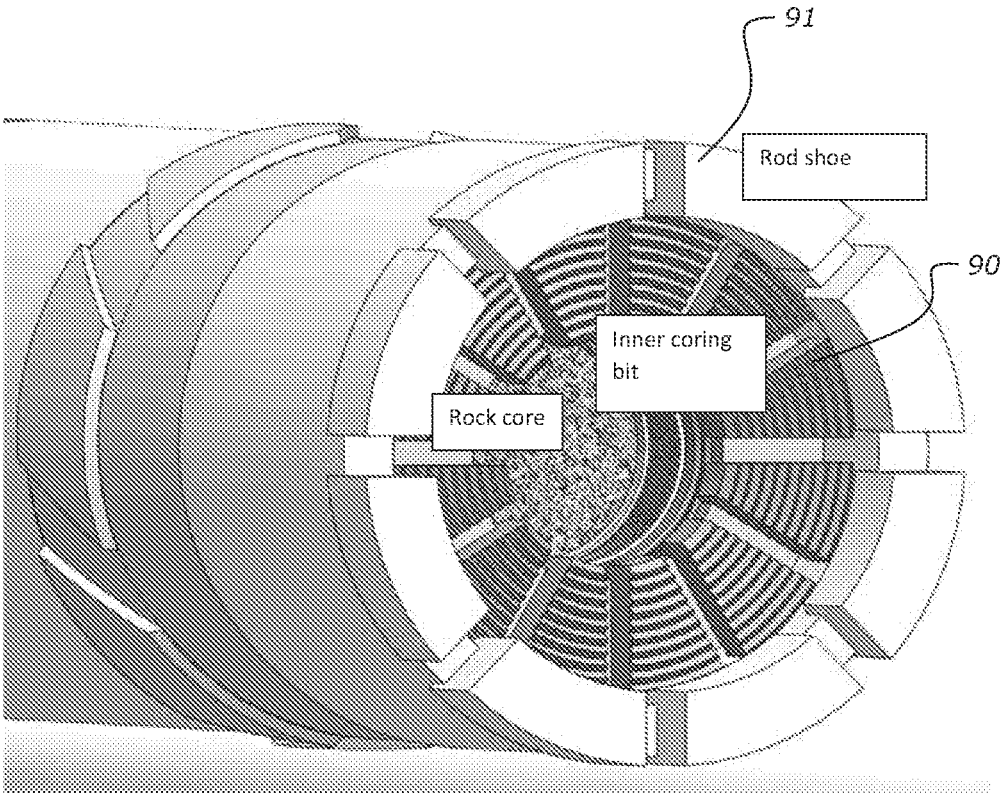

In an alternative embodiment to the above, a similar assembly is provided as per the first embodiment, except that instead of using a wide kerf drill bit that is rotated by the turbine, a rod shoe (thin kerf drill bit) is used at the end of the drill string. Referring to FIGS. 8 to 10, the drill bit 251 comprises a coring bit 90, for example a diamond impreg bit, rotated by the turbine as previously described, which rotates and sits concentrically within an outer annular shoe 91. The coring bit sits axially up hole of the casing shoe The shoe 91 is rotationally coupled via a spline to the drillstring housing 211, and can be rotated by the drill string independently of the concentric coring bit 90. During operation, the inner coring drill bit 90 is rotated in the manner as described above using the drive train 260, and its rotational speed can benefit from the combined rotation of the drill housing 211 and turbine as described. But in addition, the outer shoe 91 also rotates and is driven directly by the drillstring housing 211, which is driven by the drill rig/driver 5 at the surface. The (thin kerf casing) shoe 91 can rotate at a separate RPM to the inner concentric coring bit.

This configuration reduces the drill bit effective area that the turbine has to rotate (for example, approximately half the area). Due to the casing shoe 91 advancing into the formation ahead of the core bit—the resultant rock core is "unconfined" from its surrounding pressure or terrain—meaning that the rock core is significantly weaker than it would otherwise be. Thus the kerf of the coring bit 90 can advance through the formation with less energy (leaving a large diameter of undamaged core to advance into the core barrel for retrieval and analyses). By using this system the casing shoe (driven directly via the top drive) can be of a different composition to take advantage of the slower RPM (say 1000 RPM) but higher torque (say 800 ft/lbs) than the core bit which spins at higher speed (say 4,000 RPM) but at lower torque (say 150 ft/lbs)—enabling the two different compositions of bits (casing shoe and core bit) to rapidly advance the system as a whole. It may be desirable to have the two bits rotating in opposite directions which can aid with keeping the borehole straighter. The power output of a turbine is limited by the hydraulic HP the pump can provide, in the form of flow rate and pressure. ROP is proportional to HP input to the drill bit.

This second embodiment allows total HP to be used being doubled to drive the cutting faces, that is, say 70 HP via the drill string to the rod shoe, and 70 HP via the turbine to the inner coring bit.

It would be possible to couple either of the first and second embodiments with a mechanical, hydraulic or vibratory device, whereby benefit is gained from very high speed drill bit rotation with the benefits of such complementary devices. In some instances, the micro pulsing that a vibratory device offers is preferable.

Third Embodiment

Figure 11:
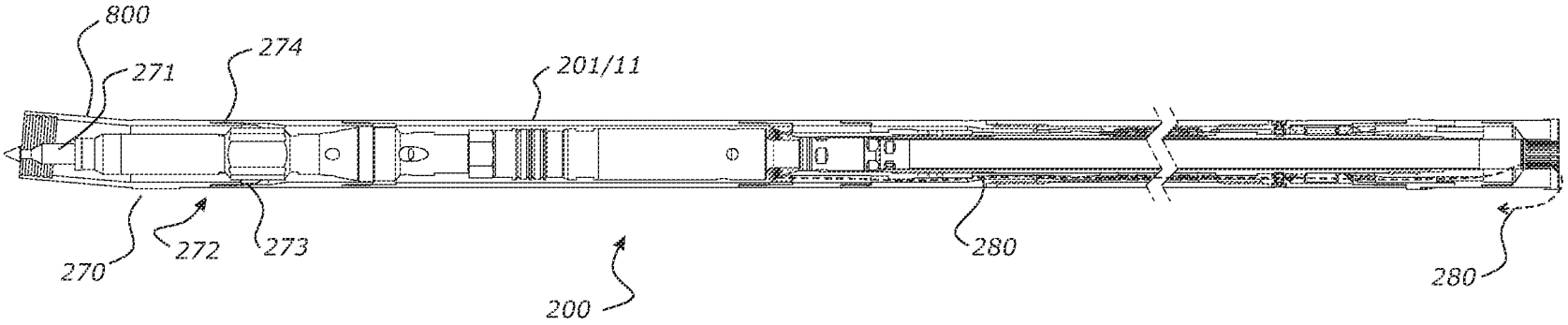
FIG. 11 shows a bottom hole assembly coring apparatus according to a third embodiment with half the drillstring casing removed to expose the components therein.

A third embodiment is shown in FIG. 11 which provides for directional drilling. It is similar to the first embodiment, except the coring apparatus housing (as described in the first embodiment) is coupled to the drillstring 11 via a bent sub 800, which can provide directional drilling/steerable coring apparatus. The bent sub 800 is a portion of housing with a slight bend in it, for example up to a 3 degree gradient. The bent sub has the same diameter size to the diameter of the core apparatus/drillstring housing so can easily be joined into place. Once in line the sub is generally situated up hole of the coring apparatus, preferably above the wireline retrievable portion. The embodiment can then be used in the manner described. This embodiment also incorporates wireline retrieval.

In field use, the drillstring can drill in the usual manner for straight drilling by rotating the drillstring housing and the turbine, the combined RPM rotating the bit. When steering of the coring apparatus 200 is required, for example, the apparatus has gone off tangent, then the drillstring 11 with the bent sub 800 can be rotated so that the drill bit points the direction required and locked into that position—by the drill rig rotationally constraining the drill rods at surface. With the mud pumps turned on, and the drill bit rotating (via the turbine but with the drill rods only able to slidably advance (without rotation)) then the drill bit will drill in the angle it is pointed. Once the directional change has been achieved and drilling straight ahead is again required, then the drill rods are unlocked and rotated in the usual manner while advancing (via the drill rig) while the drill bit is also rotated via mud flow. In this embodiment the latch 271 (see FIG. 2) has a flex joint so it is able to bend and deploy through the bent sub 800 FIG. 11.

The invention claimed is:

1. A wireline retrievable coring apparatus for incorporation into a drillstring, comprising:

a coring apparatus housing for coupling to and for rotation by a drill string housing, a drill bit, a turbine comprising:

a stator coupled to the coring apparatus housing, and an internal rotor coupled to rotate the drill bit and positioned to rotate within the stator, such that the internal rotor can rotate relative to rotation of the coring apparatus housing, a core barrel through the turbine and in communication with the drill bit for capturing a core, a fluid path to the drill bit via the turbine to rotate the turbine wherein the core barrel is rotationally isolated from the rotor and is fluidly isolated from the fluid path.

2. The coring apparatus according to claim 1 further comprising a hollow drive train within the housing and coupled to the drill bit, the rotor being coupled to or forming part of the drive train to rotate the drill bit.

3. The coring apparatus according to claim 2 wherein the core barrel is positioned in the hollow drive train and is rotationally isolated from the drive train.

4. The coring apparatus according to claim 3 wherein the core barrel is positioned in the hollow drive train by a swivel which removably holds the core barrel in but rotationally isolates the core barrel from the drive train.

5. The coring apparatus according to claim 4 wherein a slidably engageable seal is disposed between the swivel and the hollow drive train, wherein optionally the seal is pressure activated.

6. The coring apparatus according to claim 5 wherein the swivel comprises a body that is removably coupled to the hollow drive train.

7. The coring apparatus according to claim 6 wherein the core barrel is rotatably coupled to the swivel body.

8. The coring apparatus according to claim 5 wherein the seal directs fluid to the fluid path and isolates the core barrel from fluid in the fluid path.

9. The coring apparatus according to claim 4 wherein the core barrel and swivel can be retrieved from the hollow drive train.

10. The coring apparatus according to claim 4 further comprising a wireline assembly coupled to the swivel, and the core barrel and swivel can be retrieved from the hollow drive train by the wireline assembly.

11. The coring apparatus according to claim 2 wherein there is a gap between the hollow drive train and the housing forming part of the fluid path.

12. The coring apparatus according to claim 2 further comprising a radial bearing coupling the hollow drive train and the housing, the radial bearing comprising gaps forming part of the fluid path, such that fluid flow in the fluid path lubricates and/or cools the radial bearing.

13. The coring apparatus according to claim 2 further comprising a thrust bearing coupling the hollow drive train and the housing, the thrust bearing comprising gaps forming part of the fluid path, such that fluid flow in the fluid path lubricates and/or cools the thrust bearing.

14. The coring apparatus according to claim 1 wherein in use the coring apparatus is coupled to the drill string housing, such that rotation of the drill string housing rotates the coring apparatus housing and the turbine stator, and the fluid path of the coring apparatus is coupled to the fluid path of the drillstring so that fluid flows through the drill string fluid path, enters the coring apparatus fluid path and rotates the rotor relative to the rotating stator without rotating the core barrel.

15. The coring apparatus according to claim 1 wherein the housing is rotationally isolated from the drill bit.

16. The coring apparatus according to claim 1 wherein the drill bit comprises an outer shoe coupled to and rotatable by the housing and a coring bit coupled to and rotatable by the rotor of the turbine.

17. The coring apparatus according to claim 1 wherein the housing is provided with a bent sub to allow directional control.

18. The coring apparatus according to claim 1 wherein the fluid path exits at the bit to permit fluid flow in the path to exit and lubricate and/or cool the drill bit and return top hole via a borehole created by the coring apparatus.

19. A drilling apparatus comprising a drillstring with a housing, and a coring apparatus according to claim 1, wherein a housing of the coring apparatus is coupled to the housing of the drillstring such that rotation of the drill string housing rotates the coring apparatus housing and the turbine stator, and the fluid path of the coring apparatus housing is coupled to the fluid path of the drillstring so that fluid flow through the drillstring rotates the rotor relative to the rotating stator without rotating the core barrel.

20. A steerable wireline retrievable coring apparatus for incorporation into a drillstring, comprising:

a coring apparatus housing for coupling to and for rotation by a drill string housing, a bent sub coupled to said drill string housing, a drill bit, a turbine comprising:

a stator coupled to the coring apparatus housing, and an internal rotor coupled to rotate the drill bit and positioned to rotate within the stator, such that the internal rotor can rotate relative to rotation of the coring apparatus housing, a core barrel through the turbine and in communication with the drill bit for capturing a core, a fluid path to the drill bit via the turbine to rotate the turbine wherein the core barrel is rotationally isolated from the rotor and is fluidly isolated from the fluid path.

* * * * *